US009032860B2

(12) United States Patent
Faxon

(10) Patent No.: US 9,032,860 B2
(45) Date of Patent: May 19, 2015

(54) GAS PISTON OPERATED UPPER RECEIVER SYSTEM

(71) Applicant: Faxon Firearms, LLC, Cincinnati, OH (US)

(72) Inventor: Robert T. Faxon, Cincinnati, OH (US)

(73) Assignee: FAXON FIREARMS, LLC, Cincinnati, OH (US)

( * ) Notice: Subject to any disclaimer, the term of this patent is extended or adjusted under 35 U.S.C. 154(b) by 0 days.

(21) Appl. No.: 14/108,872

(22) Filed: Dec. 17, 2013

(65) Prior Publication Data

US 2014/0224114 A1 Aug. 14, 2014

Related U.S. Application Data

(60) Provisional application No. 61/737,947, filed on Dec. 17, 2012.

(51) Int. Cl.

| | |
|---|---|
| ***F41C 23/16*** | (2006.01) |
| ***F41A 3/66*** | (2006.01) |
| ***F41A 5/26*** | (2006.01) |
| ***F41A 5/28*** | (2006.01) |
| ***F41A 15/14*** | (2006.01) |
| ***F41A 5/18*** | (2006.01) |

(52) U.S. Cl.

CPC . *F41A 5/28* (2013.01); *F41A 15/14* (2013.01); *F41C 23/16* (2013.01); *F41A 3/66* (2013.01); *F41A 5/18* (2013.01)

(58) Field of Classification Search

CPC ..... F41A 3/12; F41A 3/16; F41A 3/26; F41A 3/66; F41A 3/82; F41A 3/86; F41A 5/18; F41A 5/26; F41A 15/00; F41A 15/12; F41A 15/14; F41C 23/16

USPC ..... 89/191.01, 191.02, 193, 37.07; 42/75.01, 75.02, 75.03, 75.04

See application file for complete search history.

(56) References Cited

U.S. PATENT DOCUMENTS

| | | | | |
|---|---|---|---|---|
| 2,783,685 | A | 3/1957 | Green | |
| 3,198,076 | A | 8/1965 | Stoner | |
| 3,318,192 | A * | 5/1967 | Sullivan et al. | 89/142 |

(Continued)

FOREIGN PATENT DOCUMENTS

| | | | |
|---|---|---|---|
| EP | 0198881 | B1 | 4/1992 |
| WO | 2007014770 | A1 | 2/2007 |

*Primary Examiner* — Bret Hayes
*Assistant Examiner* — Derrick Morgan
(74) *Attorney, Agent, or Firm* — Wood Herron & Evans LLP

(57) ABSTRACT

Disclosed is an upper receiver assembly for use with an AR15-type lower receiver. The upper receiver assembly includes a monolithic upper receiver and forearm housing. A barrel has a breech end, a muzzle end, a bore axis, and a barrel trunnion at the breech end having a lug for direct connection to the lower receiver using the pivot pin. It includes a bolt carrier assembly, having a longitudinal slot and rail engagement with the upper receiver housing on which the bolt carrier assembly slidably reciprocates, and a long-stroke gas-piston actuation system. A recoil spring assembly is housed within the monolithic upper receiver and forearm housing and extends coaxially with the longitudinal axis of the gas-piston actuation assembly. The barrel trunnion and gas block are configured for engagement with the upper receiver and forearm housing with longitudinal keyway features.

18 Claims, 18 Drawing Sheets

(56) References Cited

U.S. PATENT DOCUMENTS

| | | | | |
|---|---|---|---|---|
| 3,380,183 | A * | 4/1968 | Sullivan et al. | 42/75.02 |
| 3,386,336 | A | 6/1968 | Roy | |
| 3,882,625 | A * | 5/1975 | Tellie | 42/25 |
| 4,244,273 | A * | 1/1981 | Langendorfer et al. | 89/193 |
| 4,358,986 | A * | 11/1982 | Giorgio | 89/142 |
| 4,395,938 | A | 8/1983 | Curtis | |
| 4,475,438 | A * | 10/1984 | Sullivan | 89/191.01 |
| 4,654,993 | A | 4/1987 | Atchisson | |
| 4,765,224 | A * | 8/1988 | Morris | 89/191.01 |
| 5,448,940 | A | 9/1995 | Schuetz et al. | |
| 5,675,924 | A | 10/1997 | Predazzer | |
| 5,900,577 | A | 5/1999 | Robinson et al. | |
| 6,019,024 | A | 2/2000 | Robinson et al. | |
| 6,182,389 | B1 * | 2/2001 | Lewis | 42/16 |
| 6,484,430 | B1 | 11/2002 | Robinson et al. | |
| 6,536,150 | B2 * | 3/2003 | Schweikart | 42/16 |
| 6,854,206 | B2 * | 2/2005 | Oz | 42/124 |
| 7,137,217 | B2 | 11/2006 | Olson et al. | |
| 7,331,135 | B2 | 2/2008 | Shimi | |
| 7,363,741 | B2 * | 4/2008 | DeSomma et al. | 42/85 |
| 7,461,581 | B2 * | 12/2008 | Leitner-Wise | 89/191.01 |
| 7,469,624 | B1 | 12/2008 | Adams | |
| D590,473 | S | 4/2009 | Fitzpatrick et al. | |
| 7,574,823 | B2 | 8/2009 | Nakayama | |
| D600,771 | S | 9/2009 | Fitzpatrick et al. | |
| 7,596,900 | B2 | 10/2009 | Robinson et al. | |
| 7,739,939 | B2 | 6/2010 | Adams | |
| 7,775,150 | B2 | 8/2010 | Hochstrate et al. | |
| 7,798,045 | B1 | 9/2010 | Fitzpatrick et al. | |
| 7,905,041 | B1 * | 3/2011 | Davies | 42/75.02 |
| 7,921,760 | B2 | 4/2011 | Tankersley | |
| 7,934,447 | B2 | 5/2011 | Kuczynko et al. | |
| 7,938,055 | B2 | 5/2011 | Hochstrate et al. | |
| D641,825 | S | 7/2011 | Gridelet | |
| 7,971,379 | B2 | 7/2011 | Robinson et al. | |
| 7,971,382 | B2 | 7/2011 | Robinson et al. | |
| 7,971,518 | B2 | 7/2011 | Adams | |
| 7,975,595 | B2 | 7/2011 | Robinson et al. | |
| 8,051,595 | B2 | 11/2011 | Hochstrate et al. | |
| 8,056,460 | B2 | 11/2011 | Herring | |
| 8,096,074 | B2 | 1/2012 | Robinson et al. | |
| 8,109,193 | B2 | 2/2012 | Herring | |
| 8,109,196 | B1 | 2/2012 | Spence | |
| 8,141,285 | B2 * | 3/2012 | Brown | 42/71.01 |
| 8,166,864 | B2 | 5/2012 | Herring | |
| 8,181,563 | B1 | 5/2012 | Peterken | |
| 8,201,489 | B2 | 6/2012 | Juarez | |
| 8,276,303 | B2 * | 10/2012 | Kapusta et al. | 42/71.01 |
| 8,286,541 | B2 | 10/2012 | Lorenzut | |
| 8,336,243 | B2 * | 12/2012 | Langevin et al. | 42/71.01 |
| 8,359,779 | B2 * | 1/2013 | Daniel et al. | 42/75.03 |
| 8,667,882 | B1 * | 3/2014 | Larson et al. | 89/193 |
| 8,863,426 | B1 * | 10/2014 | Zinsner | 42/71.01 |
| 2003/0208942 | A1 * | 11/2003 | Beretta | 42/75.02 |
| 2007/0017139 | A1 * | 1/2007 | Larue | 42/75.1 |
| 2007/0199435 | A1 | 8/2007 | Hochstrate et al. | |
| 2008/0301994 | A1 | 12/2008 | Langevin et al. | |
| 2010/0186582 | A1 | 7/2010 | Juarez | |
| 2010/0218671 | A1 | 9/2010 | Mayberry et al. | |
| 2011/0023700 | A1 | 2/2011 | Herring | |
| 2011/0061281 | A1 * | 3/2011 | Kapusta et al. | 42/71.01 |
| 2011/0088304 | A1 | 4/2011 | Lorenzut | |
| 2011/0094373 | A1 | 4/2011 | Cassels | |
| 2011/0119981 | A1 * | 5/2011 | Larue | 42/71.01 |
| 2011/0168009 | A1 * | 7/2011 | Robb et al. | 89/194 |
| 2011/0271827 | A1 * | 11/2011 | Larson et al. | 89/193 |
| 2012/0036756 | A1 * | 2/2012 | Brown | 42/71.01 |
| 2012/0042769 | A1 | 2/2012 | Makayama et al. | |
| 2012/0102803 | A1 * | 5/2012 | Troy et al. | 42/71.01 |
| 2012/0180354 | A1 * | 7/2012 | Sullivan et al. | 42/16 |
| 2012/0186123 | A1 * | 7/2012 | Troy et al. | 42/71.01 |
| 2013/0125440 | A1 * | 5/2013 | Zheng | 42/14 |
| 2013/0205637 | A1 * | 8/2013 | Patel | 42/75.02 |
| 2013/0219763 | A1 * | 8/2013 | Nunes | 42/16 |
| 2014/0075804 | A1 * | 3/2014 | Langevin et al. | 42/16 |
| 2014/0075807 | A1 * | 3/2014 | Lewis | 42/25 |
| 2014/0076144 | A1 * | 3/2014 | Gomez | 89/132 |
| 2014/0090283 | A1 * | 4/2014 | Gomez | 42/25 |
| 2014/0224114 | A1 * | 8/2014 | Faxon | 89/193 |

* cited by examiner

GAS PISTON OPERATED UPPER RECEIVER SYSTEM

RELATED APPLICATION

This application claims the benefit of U.S. Provisional Patent Application No. 61/737,947 filed Dec. 17, 2012.

FIELD OF THE INVENTION

This invention generally relates to a gas piston unitary upper receiver system for an automatic or semiautomatic firearm, particularly for use with a standard AR15/M16 lower receiver.

BACKGROUND OF THE INVENTION

Issues with the direct impingement operation system of the AR15/M16 rifle (and variants thereof) are well known. Many attempts have been made to replace the original direct impingement operation system with a gas piston system. Some proposals are retrofit systems, in which the original gas tube is replaced with a piston and cylinder for short stroke operation of the bolt. These systems typically use the existing buffer spring that extends into the butt stock. Other solutions have been proposed in which an entirely new rifle is designed to include operator controls similar to those familiar in the AR15/M16 platform. For example, Remington Arms has produced its Adaptive Combat Rifle (ACR) and FN Herstal (FNH USA) has proposed its MK16 and MK17 rifles, the latter of which was adopted by the United States Special Operations Command (SOCOM) as a result of the Special Operations Forces Combat Assault Rifle (SCAR) competition. Each of these examples includes a recoil spring within the upper receiver, allowing the butt stock to be folded, if desired. These designs, however, utilize a unique (nonstandard) lower receiver and require complete replacement of existing rifle systems, rather than allowing modification of existing weapons currently in inventory.

SUMMARY OF THE INVENTION

The present invention provides a number of features. It has a unitary upper receiver that mounts to any standard AR15/M16 lower receiver. The upper receiver, which houses a reciprocating bolt carrier assembly is unitary with a forearm portion which supports a barrel assembly, gas piston operation system, and charging handle. The gas operation system includes a long-stroke piston for positive operation of the bolt carrier assembly without introduction of dirty gases into the upper receiver and bolt carrier area. This allows the use of a non-reciprocating charging handle, which is fully ambidextrous and reduces the mass of reciprocating parts.

Unique geometry of the bolt carrier allows it to reciprocate on replaceable rails, which reduces the frictional contact area, can be provided with self-lubricating coatings, and allows axial alignment between the operation rod and recoil spring. According to one embodiment, a novel bolt is provided which allows it to be repositioned by the user for left- or right-handed (fully ambidextrous) operation. The unique geometry of the recoil spring and operation rod allows recoil forces of the reciprocating bolt carrier and piston rod assembly to be transferred to a robust portion of the upper receiver, rather than through a recoil spring and buffer housed in the butt stock of a typical AR15/M16 rifle platform, without tipping the bolt carrier.

The invention also provides a quick-change barrel assembly, held in place by a lower forearm cover, with a barrel trunnion that connects directly to the pivot pin of the lower receiver. The barrel assembly, comprising a barrel, barrel trunnion, gas block, gas regulator valve, and gas cylinder, can be easily removed and replaced as a unit. This allows quick change in barrel length, caliber, and twist rate, as desired by the user. Because the gas regulator valve and gas cylinder are part of the interchangeable barrel assembly, the gas control system may be matched to the characteristics of the barrel (caliber, and length, and twist rate) without any change to the gas piston, which remains connected to the bolt carrier assembly.

Because the recoil spring and buffer system is housed within the upper, it may be used with a folding stock in a rifle system or without any rearward protrusion in a pistol platform.

According to another feature of the invention, a clean-out port is provided in the gas block in axial alignment with the gas port and gas passageway in the barrel and gas block. When the gas regulator valve is removed, this allows direct access for cleaning these passageways without any other disassembly of the unit.

According to another feature of the invention, a two-stage recoil spring and buffer system may be used. This system provides rapid deceleration of the bolt carrier assembly during the final portion of rearward cycle.

According to another feature of the invention, a bolt having improved curvilinear lug geometry provides increased strength and resistance to cracking by minimizing or eliminating sharp edge cuts in the bolt face profile.

Other features, benefits, and combinations will be apparent from the various figures of the drawing and detailed description of preferred embodiments herein.

BRIEF DESCRIPTION OF THE DRAWINGS

Like reference numerals are used to indicate like parts throughout the various figures of the drawings, wherein.

DETAILED DESCRIPTION

Figure 1:
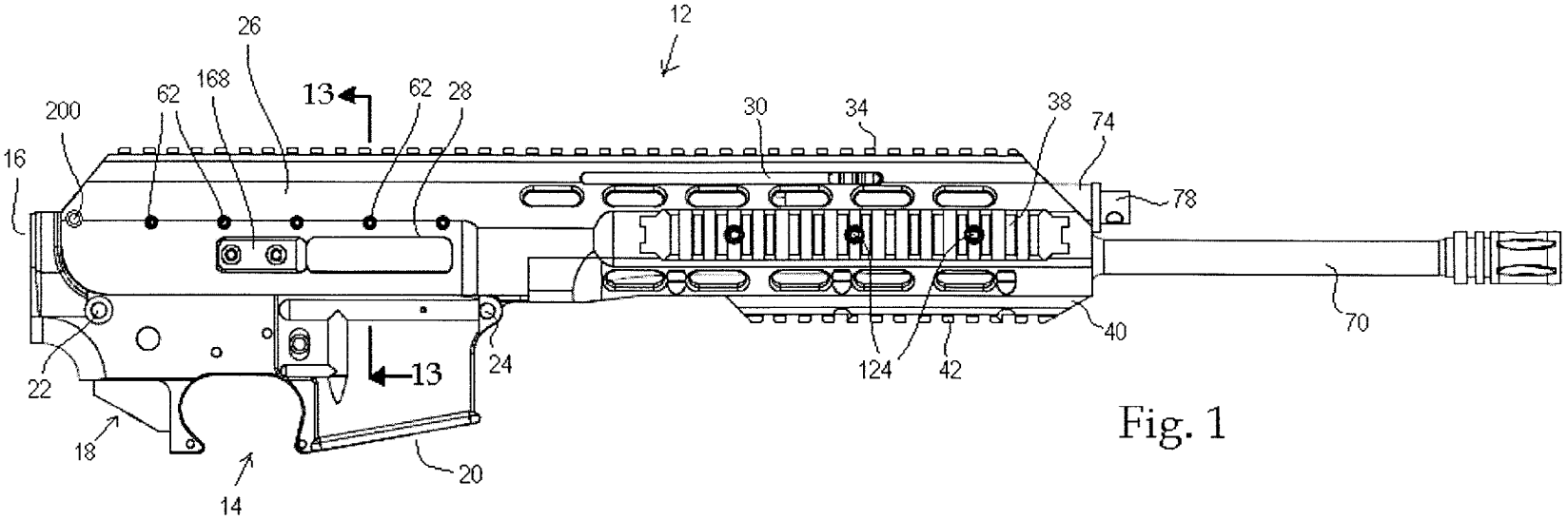
FIG. 1 is a right side plan view of an upper assembly according to an embodiment of the invention shown mounted on a stripped lower receiver.

Referring to the various figures of the drawing, and first to FIG. 1, therein is shown a firearm having a gas piston operated unitary upper receiver assembly 12 mounted on a standard AR15/M16 lower receiver assembly. The lower receiver 14 may be that of a standard AR15/M16 rifle (or pistol). As used herein, the terms AR15, M16, M4, and other variants of these firearm platforms are used interchangeably. The present invention is operable in semiautomatic mode or may be operable in full automatic mode with appropriate modification. FIGS. 1-4 illustrate a lower receiver 14 without a fire control group (lower parts kit), butt stock, hand grip or magazine. A butt stock mountable to any standard AR platform variant can be attached at 16, a hand grip at 18, and a removable magazine inserted into a magazine well 20. A wide variety of stocks, grips, and accessories are available to interface with the standard AR15 lower receiver 14. Specifics of these parts are not important to the present invention, and for sake of simplicity, are not shown in the other figures. The upper receiver assembly 12 of the present invention is fully usable with a lower receiver 14 in a pistol configuration (not shown). The present invention also allows use of a folding stock (not shown), if desired, or continued operation after the butt stock has been bent or broken.

The upper receiver assembly 12 attaches to the lower receiver 14 using the standard takedown pin 22 and pivot pin 24. By utilizing a standard AR15/M16 platform lower receiver 14, existing weapons systems may be upgraded without replacement, particularly of the serialized lower receiver 14, legally considered to be the "firearm."

The upper receiver assembly 12 includes a unitary upper receiver body 26 which may be billet milled or otherwise formed of a suitable material, such as an aluminum alloy. Alternatively, an extrusion of a suitable profile may also be formed and milled to final specifications or could be molded from a suitable polymer material.

Figure 4:
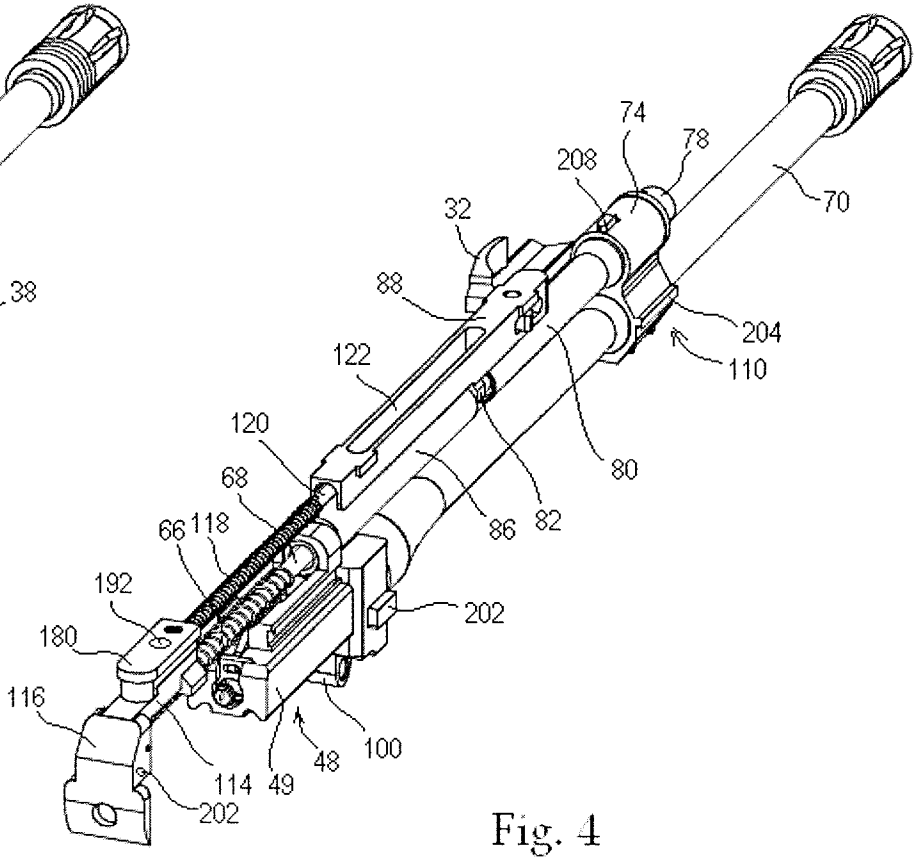
FIG. 4 is a pictorial view similar to FIG. 3 in which the upper receiver body has been removed to expose the inner working parts of the device.
Figure 3:
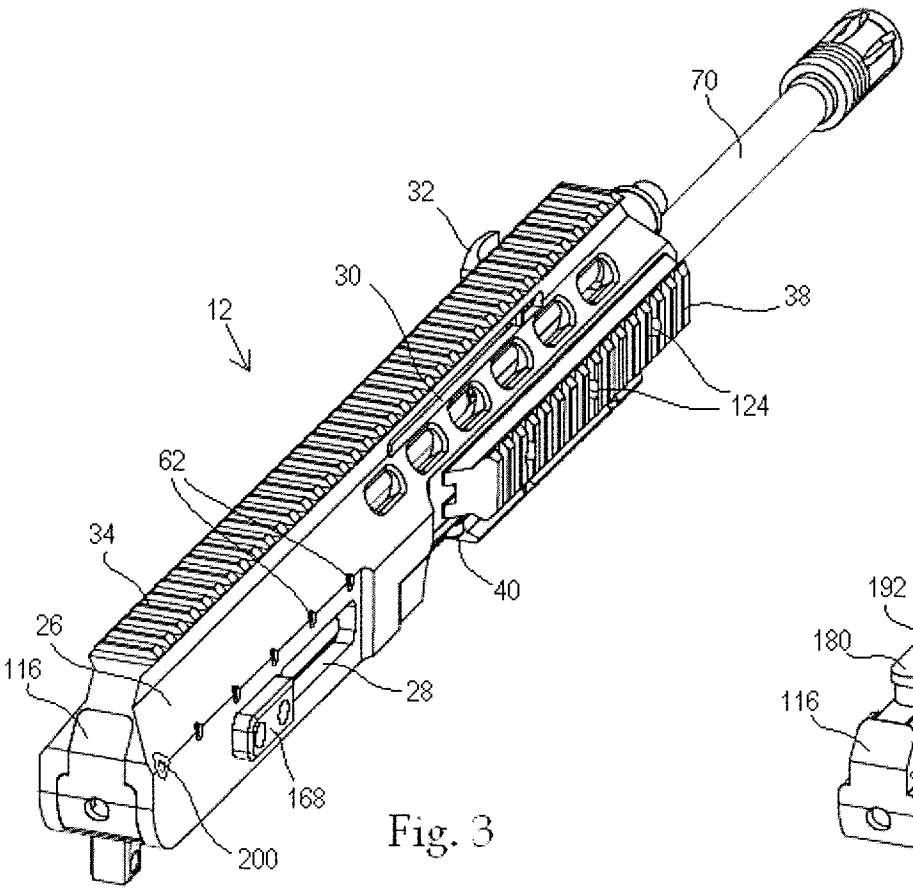
FIG. 3 is an isometric rear-side view of the upper receiver assembly shown in FIG. 1.

As shown in FIGS. 1 and 3, an ejection port 28 is provided on one side, in this example, the right-hand side. An elongated charging handle opening 30 is provided on each side of the receiver body 26 to allow longitudinal movement of a laterally extending charging handle lever 32. The charging handle lever 32 may be switchable without tools from either side to the other at the operator's discretion. The upper receiver body 26 includes a unitary fore end (forearm) and may include an integral top Picatinny (MIL-STD 1913) accessory mounting rail 34. Additional accessory rails 36, 38 may be provided at the 9 o'clock and 3 o'clock positions. A separate lower forearm cover 40 may also include a bottom accessory rail 42. FIGS. 3 and 4 show the upper assembly 12 separate from the lower receiver assembly. Unlike a typical AR15 variant receiver having a rear charging handle, the upper receiver assembly 12 of the present invention is completely closed at its rear end, which is adjacent the operator's face when shooting, precluding any undesired escape of gases or combustion particles and providing enhanced strength.

Figure 2:
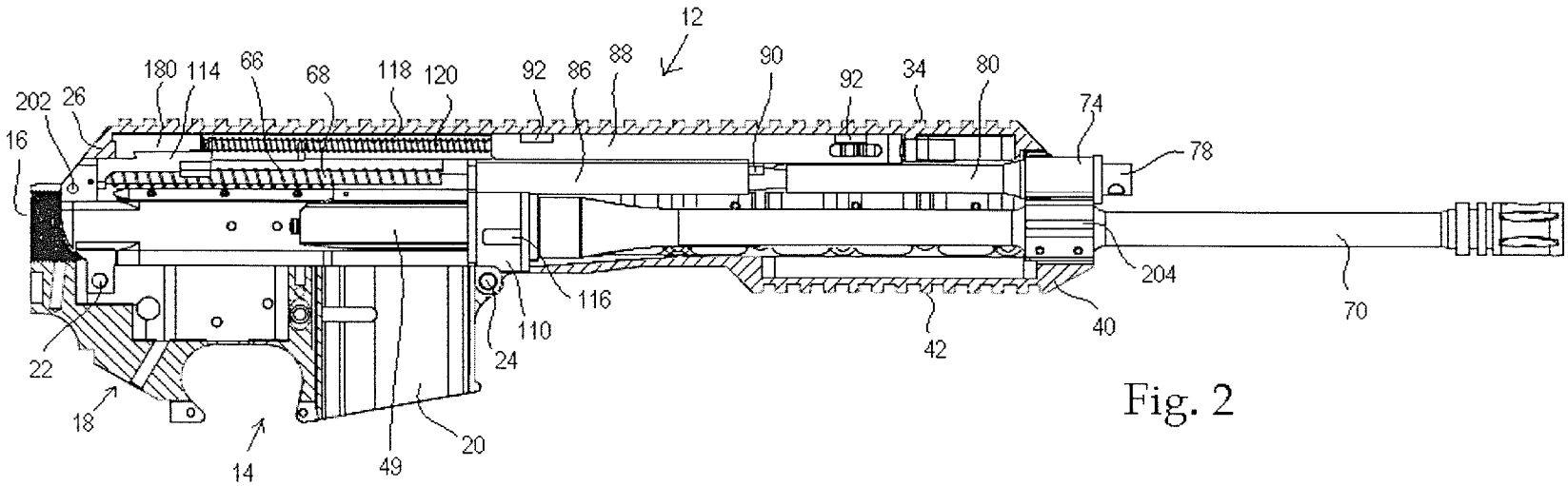
FIG. 2 is a view similar to FIG. 1, showing the upper receiver body, lower receiver, and lower forearm cover cutaway in longitudinal cross-section.

Referring now to FIGS. 2, 3 and 4, therein can be seen a gas piston operating system according to the present invention. FIG. 2 is a side plan view showing the upper receiver assembly 12 and a stripped lower receiver 14 in longitudinal section. FIG. 4 shows an isometric view of the entire internal system, but with the upper receiver body 26 being shown cut away in cross-section. The trigger and hammer mechanism parts of the lower receiver 14 are not shown for sake of clarity and because they do not form any part of the present invention. The trigger assembly and selector switch for any standard semiautomatic or fully automatic AR variant will function with the present invention.

Referring now in particular to FIGS. 2, 4, 7, 19 and 20, the present invention provides a novel bolt carrier assembly 48. The bolt carrier assembly 48 has a body 144 that is relatively square in cross-section rather than the typical round shape used in a direct impingement or gas piston conversion AR15/M16 variants. Also, rather than having a relatively large surface area of the bolt carrier in sliding contact within a generally tubular upper receiver, the present bolt carrier body 49 has lateral guide channels 54, 56 which engage and slide along left and right guide rails 58, 60. In preferred form, the guide rails 58, 60 are made of a hardened and wear-resistant material, such as steel, and may include a lubricious coating. These guide rails 58, 60 are fixed into channels formed longitudinally inside the upper receiver body 26 and may be secured by a series of threaded fasteners 62. The reciprocation track provided by these guide rails 58, 60 is closely adjacent to and parallel with the axis of the gas piston system (to be described below) and is vertically situated between the gas-piston/recoil-spring axis and the bore axis of the barrel. This orientation produces less angular loading on the bolt carrier body 49 and other parts that reciprocate when the action is cycled.

Figure 6:
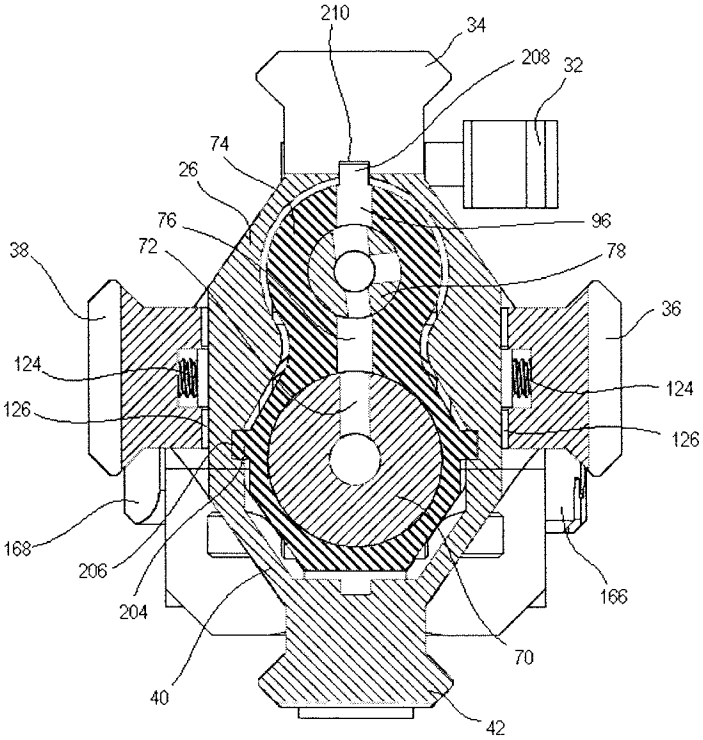
FIG. 6 is a cross-sectional view taken substantially along line 6-6 of FIG. 5.

Operation of the gas piston system can be seen by reference to FIGS. 2, and 4-6. The barrel 70 includes a gas port 72. A gas block 74 is positioned on the barrel 70 and fastened such as by pinning. The gas block 74 includes a gas passageway 76 and houses an adjustable gas valve 78. Referring now particularly to FIG. 6, the gas valve 78 may be rotatably adjusted to provide a larger or smaller orifice, or may be positioned to completely close the gas passageway 76 for operation in a single shot mode. Accordingly, adjustment of the gas valve 78 allows the gas system to be "tuned" as required by variations in ammunition or use of a noise suppressor.

In autoloading mode, the gas valve 78 directs gas pressure from the bore of the barrel 70 into a gas tube or cylinder 80, which is affixed to and extends rearwardly from the gas block 74. A piston rod 82, having a piston head 84, is positioned within the cylinder 80 and is acted upon by gases ported from the barrel 70 through the gas block 74 and valve 78. The piston rod 82 extends rearwardly to an integral operation rod (op rod) 86, which is attached by threaded engagement to the forward bolt carrier lug 50 of the bolt carrier body 49.

Figure 26:
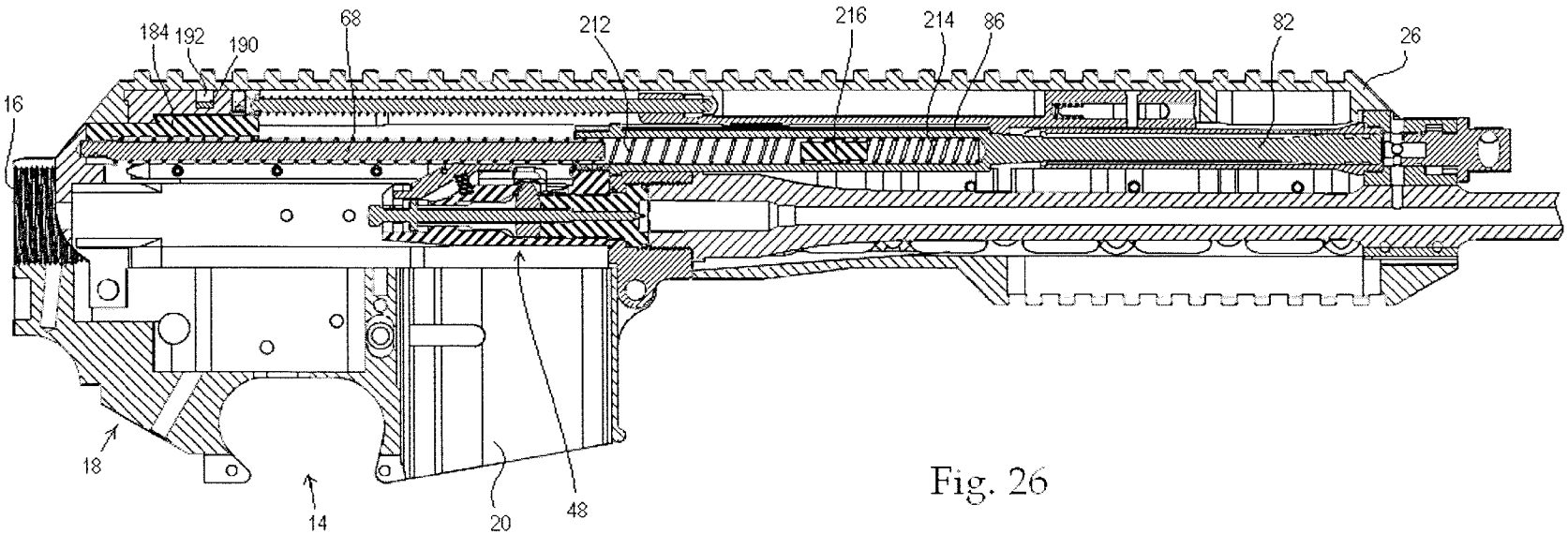
FIG. 26 is a view of the upper assembly showing a two-stage recoil spring system in a first, in battery position.
Figure 27:
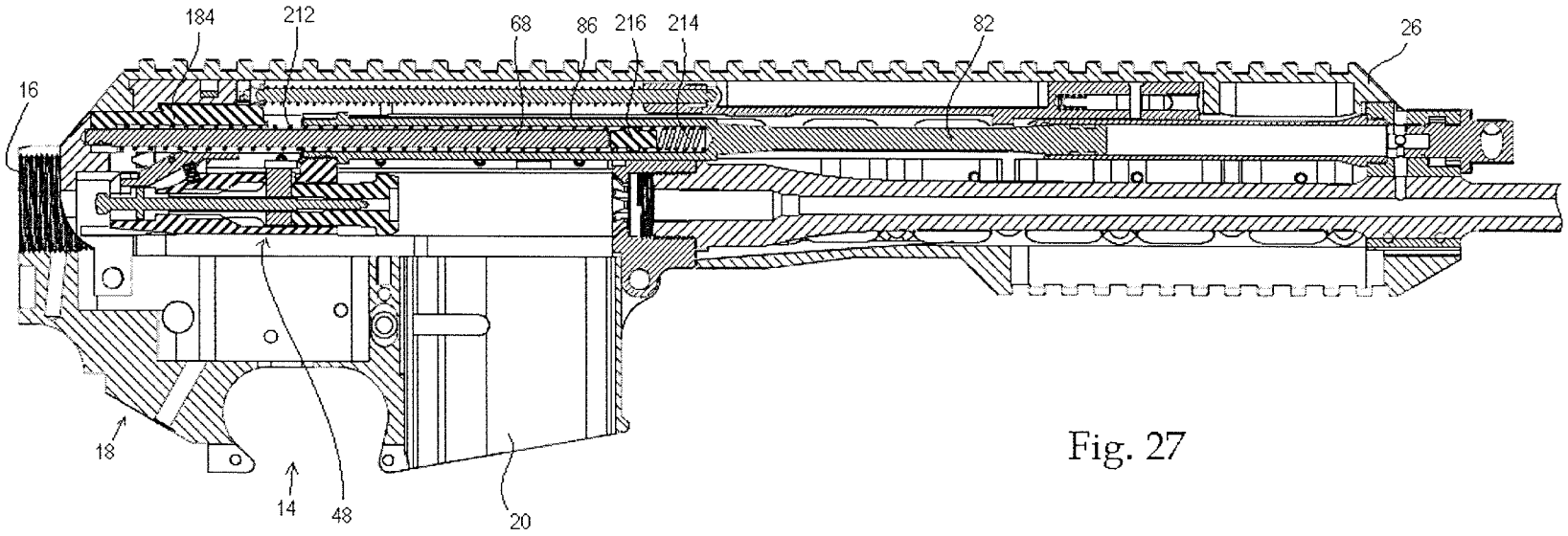
FIG. 27 is a view Like FIG. 26 showing the two-stage recoil spring system in a second, less-than-fully-retracted position.
Figure 28:
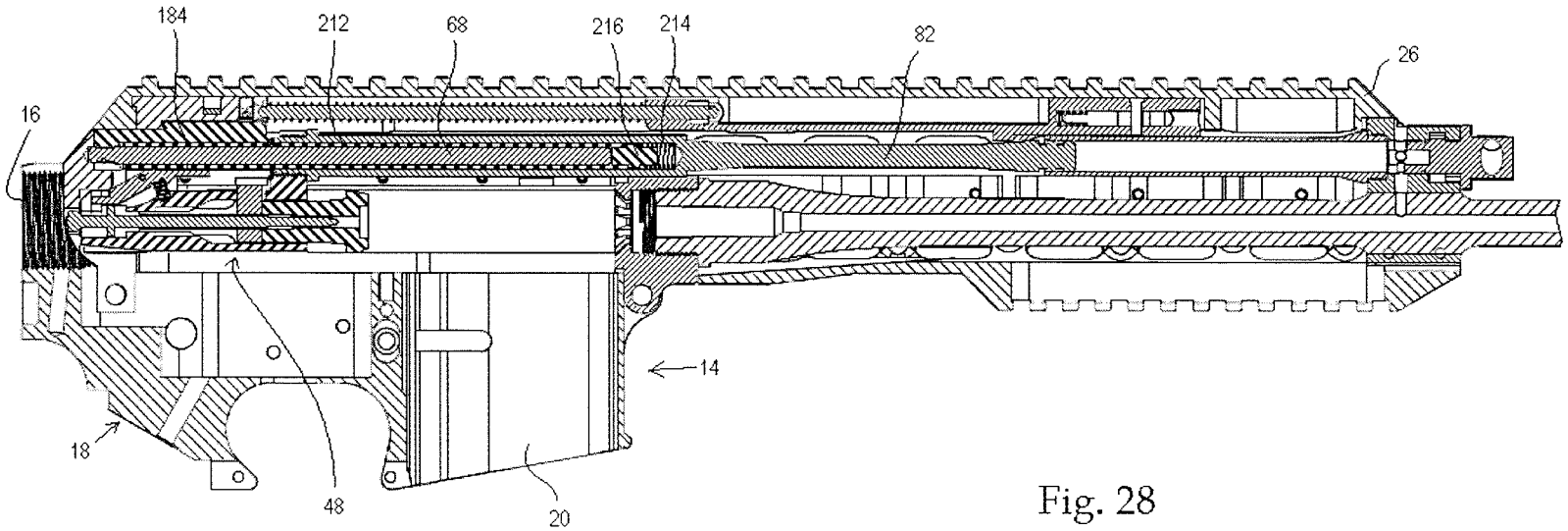
FIG. 28 is a view Like FIGS. 26 and 27 showing the two-stage recoil spring system in a third, fully retracted position.

Referring now also generally to FIGS. 26-28, when gas pressure bears upon the piston head 84, the piston rod 82 and op rod 86 are shifted rearwardly in a long-stroke operation to cycle the bolt carrier assembly 48 against the force of the recoil spring 66. The op rod 86 may be tubular, as shown, in order to reciprocate over the guide rod 68 and spring 66. This tubular portion of the op rod 86 may also be skeletalized with holes in order to reduce weight. Unless the bolt carrier 49 is locked back in an open position, the recoil spring will return these parts to their forward, in-battery position (FIGS. 2, 4 and 26). As is apparent from the figures, the gas piston 82, op rod 86, recoil spring 66, and its guide rod 68 are all axially aligned. The bolt carrier assembly 48 reciprocates along a parallel track on closely adjacent guide rails 58, 60 which are situated between the bore axis of the barrel 70 (and bolt 44) and the axis of the piston 82, op rod 86, and recoil spring 66. Thus, angular forces and any tendency for tipping of the bolt carrier assembly 48 are minimized.

Figure 5:
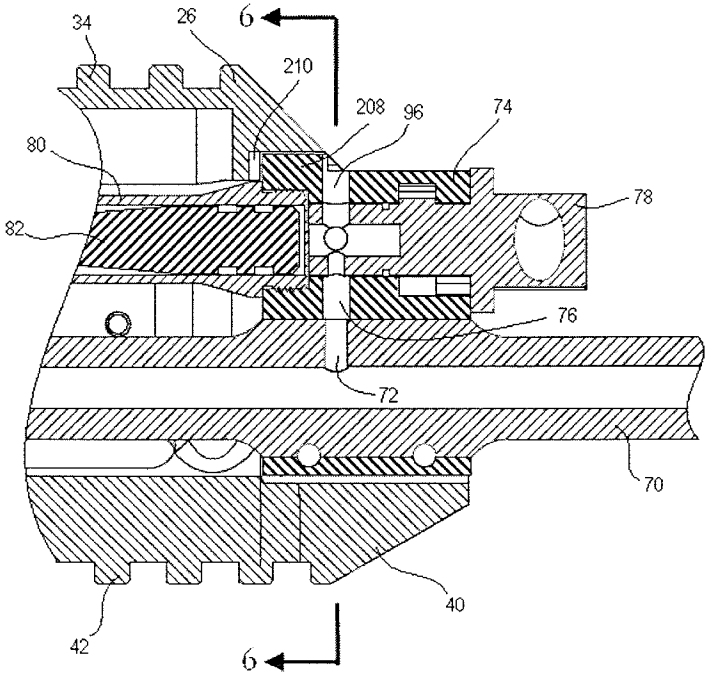
FIG. 5 is a fragmentary longitudinal sectional view of the gas block and gas regulator valve.

Referring to FIGS. 5 and 6, according to another feature of the invention, a cleaning port 96 may be provided in the gas block 74 in axial alignment with the gas passageway 76 and gas port 72. When the adjustable gas valve 78 is removed, this allows cleaning access to the gas passageway 76 and gas port 72 without any other disassembly being required.

The barrel assembly 110 includes the barrel 70, barrel trunnion 98, gas block 74, gas pressure control valve 78, and gas cylinder 80. The bolt carrier assembly 48 includes a bolt carrier body 49, a forwardly-extending tubular op rod 86, gas piston 82, bolt 44, and firing pin 46. The recoil buffer assembly 112 includes a removable buffer block 114, a rear closure plate 116, a guide rod 154, and recoil spring 156.

The action may be manually cycled by pulling the charging handle lever 32 (shown in a forwardly folded position in FIGS. 3, 4, and 6) rearwardly to slide the charging handle body 88. The charging handle body 88 includes forward and rearward laterally-extending guide ribs 92 which travel in longitudinal guide grooves 94 formed in the upper interior portion of the receiver body 26. The charging handle body 80 also includes a downwardly-extending lug 90 which provides a one-way engagement with the forward end of the op rod 86. In preferred form, the charging handle body 88 and charging handle lever 32 do not reciprocate as the gas piston system cycles, but may be used to manually cycle the action against the recoil spring 66. As shown in FIGS. 1, and 3, the charging handle body 88 includes a pair of laterally extending guide ribs 92 which slide along guide grooves 94 formed longitudinally on the inside of the upper receiver body 26. The charging handle body 88 is elongated in order to completely close the charging handle openings 30 when in its forward-most position. According to another feature of the invention, explained in further detail below, the charging handle lever 32 may be easily switched by the user from the left side to the right side through either charging handle opening 30. The charging handle body 88 may be disassembled from the upper receiver body 26 by removing the charging handle lever 32 and aligning the ribs 92 with downward openings (not shown) in the guide grooves 94 at a rearward position beyond that normally encountered by manually cycling the action.

Manual rearward cycling of the charging handle body 88 displaces the bolt carrier assembly 48 (via op rod 86) rearwardly, compressing the recoil spring 66. As shown in this embodiment, a charging handle return spring 118, carried by a guide rod 120, may be included to bias the charging handle body 88 back toward a forward position, even when the bolt carrier assembly 48 is locked in an open, rearward position (FIG. 28). As in the previously-described embodiment, the receiver body 26 may include both left and right charging handle openings 30 in order to allow the charging handle lever 32 to be switched between left-handed and right-handed operation orientation. The charging handle body 88 completely covers and closes both charging handle openings 30 when it is in its normal forward position. In this embodiment, the charging handle body 88 includes a central opening or bore 122 which receives the guide rod 120 when the charging handle body 160 is manually reciprocated rearwardly.

Referring now to FIGS. 1, 3, and 6, according to another feature of this embodiment, the receiver body 26 may include removable left and right accessory mounting rails 36, 38 corresponding to the three o'clock and nine o'clock positions. The rails 36, 38 may be attached with threaded fasteners 124 and may include a heat shield or insulating shim 126 (shown in FIG. 6) to reduce heat transfer between the receiver body 26 and accessory mounting rails 36, 38. If desired, the bottom rail 42 on the lower forearm cover 40 may be made as a separate piece and attached in a similar manner. Alternatively, the accessory rails 36, 38, 42, may be made of a non-metallic, polymer material that is a poor thermal conductor to reduce heat transfer.

Referring now to FIGS. 5 and 6, therein is shown longitudinal- and cross-sectional detail views of the gas block 74 and gas valve 78. The gas block 74 includes a multi-position gas valve 78 which is rotationally adjustable and removable. The gas valve body 78 may be retained in any of the selected positions by an internal spring detent (not shown). When the gas adjustment control valve body 78 is removed, there is direct and axially-aligned access to the gas cylinder 80 for cleaning and maintenance. Also as described with respect to the previous embodiment, the gas block 74 may include a cleaning port 96 which is axially aligned with the gas port 72 of the barrel 70 and gas passageway 76. This feature allows direct access to these passageways which may become fouled and are otherwise difficult to physically clean.

Figure 7:
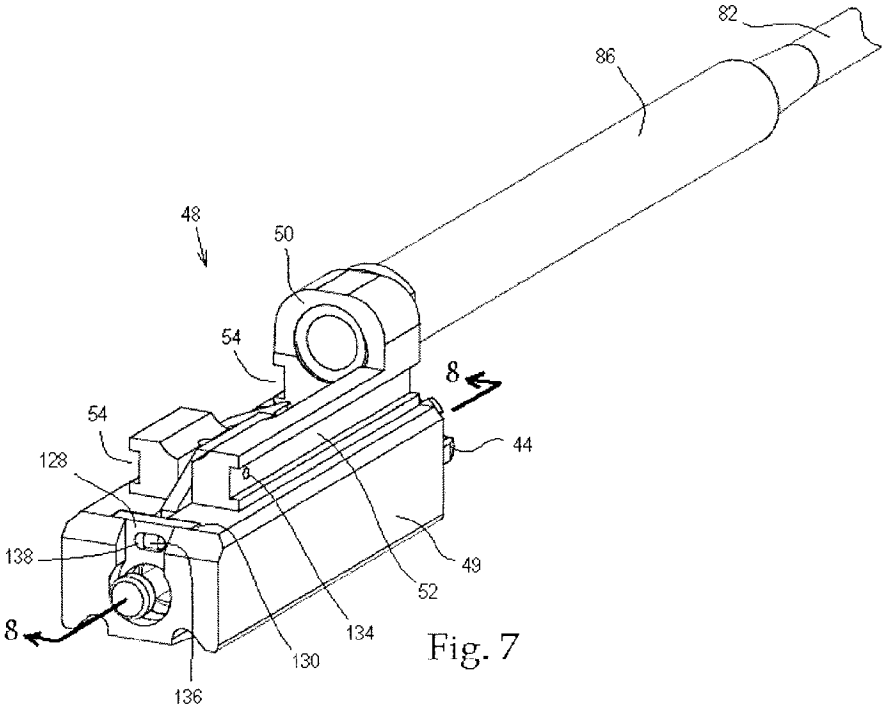
FIG. 7 is a fragmentary pictorial view of the bolt carrier assembly.

As shown in FIG. 7, the bolt carrier assembly 48 includes a bolt carrier body 49 with an upwardly-extending forward bolt carrier lug 50 to which the tubular op rod 86 is attached. The bolt carrier body 49 includes upper left and right guide channels 54, 56 which slidingly engage longitudinal guide rails 58, 60 along the interior of the receiver body 26 (see FIGS. 13, 21 and 22). The guide rails 58, 60 may be made of a hardened and wear-resistant material, such as steel, and may include a lubricious coating. If desired, exterior portions of the bolt carrier body 49, particularly the guide channels 54, 56, may also be provided with a lubricious coating.

In the illustrated embodiment, the right guide channel 56 extends along a substantial portion of the overall length of the bolt carrier body 49. The left guide channel 54 is interrupted between forward and rearward sections to allow for other mechanical structure and operations of the bolt carrier assembly 48. These bolt carrier guide channels 54, 56 are positioned vertically between a longitudinal axis of the gas piston 82, op rod 86, forward bolt carrier lug 50, and recoil spring 66 and the vertical axis of the barrel 70 and bolt 44. Accordingly, recoil forces acting on the bolt carrier assembly 48 as it cycles resist tipping, which could cause uneven and undesirable wear and friction.

Figure 8:
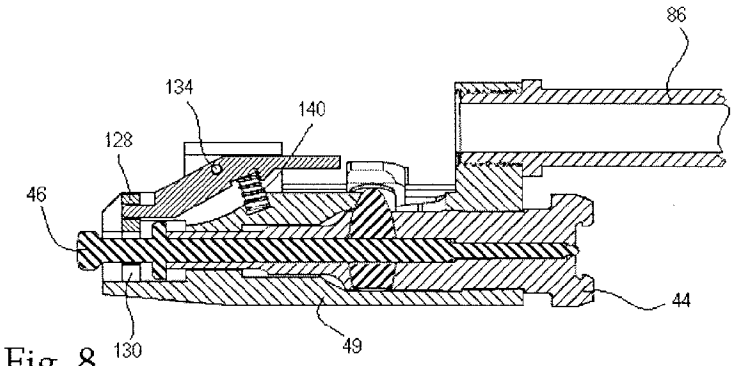
FIG. 8 is a longitudinal sectional view taken substantially along line 8-8 of FIG. 7.
Figure 9:
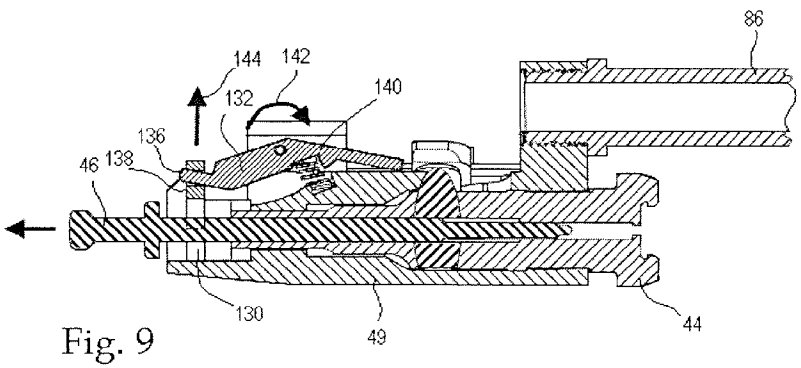
FIG. 9 is a view similar to FIG. 8 showing the firing pin retention gate lifted and the firing pin partially removed.

Referring now also to FIGS. 8 and 9, therein is shown another feature of the present invention. Removal of the firing pin 46 is made easy by a vertically displaceable firing pin retention gate 128 that is retained by and slides in opposite vertical channels 130 provided in the bolt carrier body 144. The retention gate 128 is actuated by a lift lever 132 which is mounted on a pivot pin 134 extending between the left and right guide channels 54, 56. The lift lever 132 includes a tooth 136 that pivotally engages a window or socket 138 in the firing pin retention gate 128. The lift lever 132 may be biased by a spring 140 into a closed position, as shown in FIG. 8. As shown in FIG. 9, when the lift lever 132 is pivoted (arrow 142), the tooth 136 is moved to lift (arrow 144) the firing pin retention gate 128 to a position allowing the firing pin 46 to be slid rearwardly out of the bolt 44. This feature of the invention allows field removal of the firing pin 46 for disassembly of the bolt carrier 48 without risk of losing a small retainer pin, as used in the prior art.

According to another aspect of the invention, the upper receiver assembly 12 can easily be manufactured and set up to eject spent casings to either the right or left side. Moreover, it can be made to be easily convertible by the user to operate in either a left-hand or right-hand mode. As previously described, the charging handle lever 32 is easily switchable from side to side. Additionally, a novel bolt design allows the user to selectively choose whether it is configured to eject spent casings toward the left or toward the right.

Figure 10:
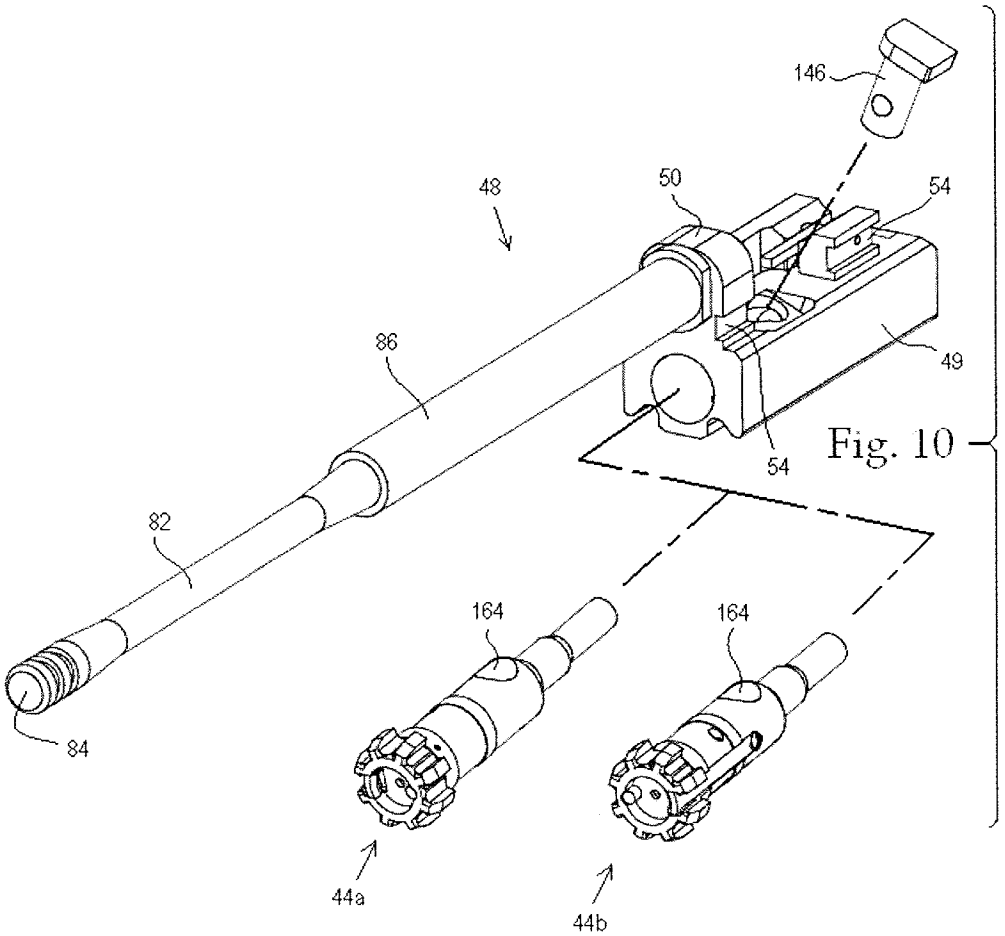
FIG. 10 is an exploded pictorial view of the bolt carrier assembly showing how the bolt is repositioned to change between left-handed and right-handed operation.

Referring first to FIG. 10, therein is illustrated how the bolt 44 is easily removed in a forward direction from the bolt carrier body 49. The firing pin 46 (not shown in FIG. 10) is removed longitudinally, followed by removal of the bolt cam pin 146, which allows the bolt 44 to be slid forwardly out of the bolt carrier body 49. The bolt 44 can then simply be axially rotated 180° and reassembled into the bolt carrier body 49 with the bolt cam pin 146 and firing pin 46.

Figure 11:
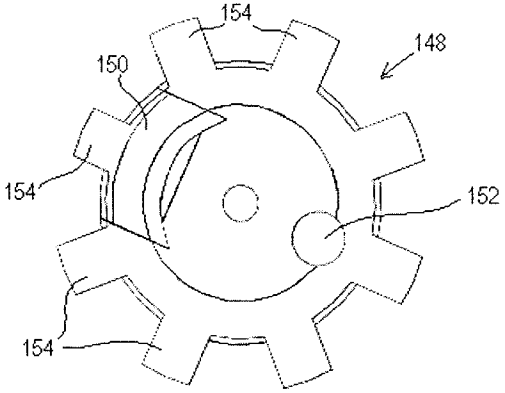
Fig. 11 (PRIOR ART)
FIG. 11 is a plan view of the face of a prior art bolt.
Figure 12:
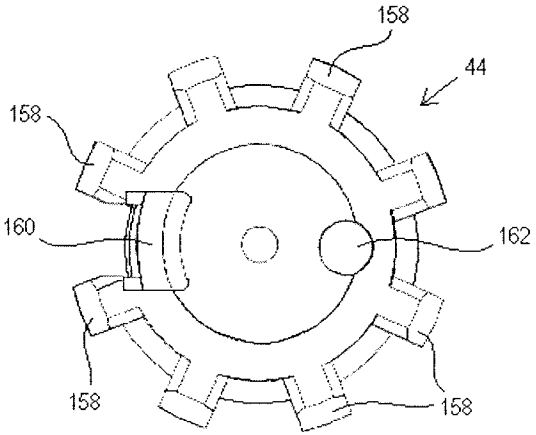
FIG. 12 is an end plan view of a bolt face according to one embodiment of the present invention.
Figure 17:
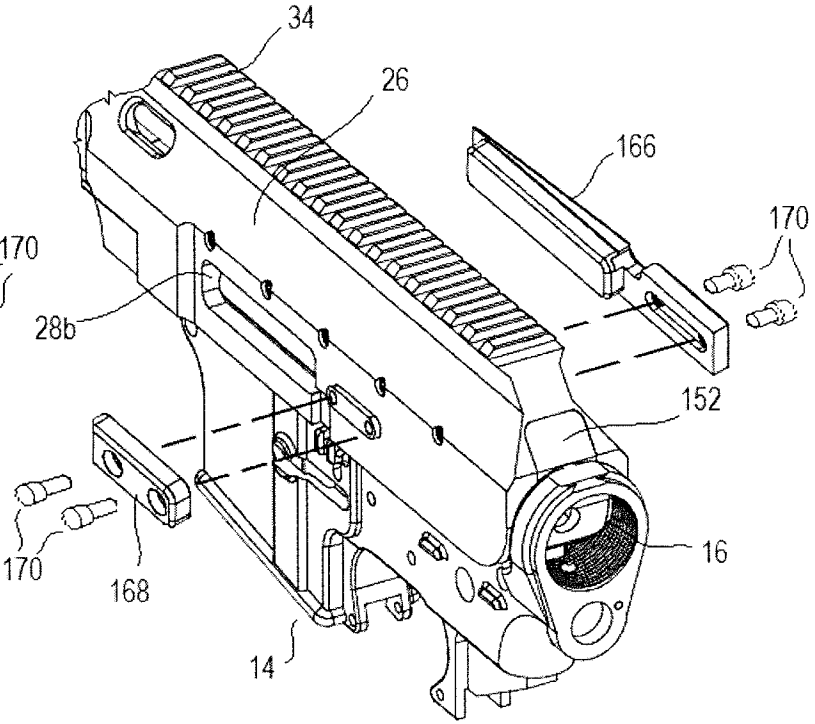
FIG. 17 is a partially exploded view similar to FIG. 15, but with the interchangeable parts reversed for left-handed operation.
Figure 16:
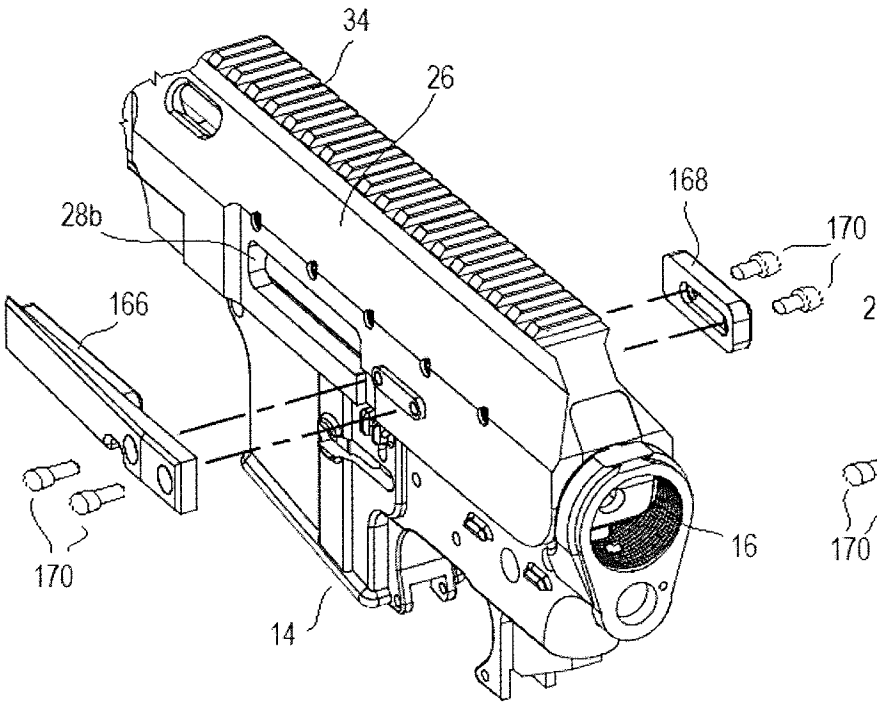
FIG. 16 is a partially exploded view similar to FIG. 14.

As shown in FIGS. 11 and 12, the geometry of the bolt head and face may differ significantly from the standard prior art bolt used in an AR15/M16 platform firearm. In the prior art bolt head 148, the extractor 150 and ejector 152 are positioned to eject a spent casing at approximately a 2 o'clock position (as viewed from the rear). The prior art bolt head 148 includes 8 radially-extending lugs, including one 154 carried by the extractor 150. The bolt head 156 of the present invention also includes eight lugs 158 in a geometric orientation similar to that of the prior art bolt head 148. However, the extractor 160 is positioned between lugs 158. Thus, the extractor 160 and ejector 162 may be positioned at substantially horizontally opposed locations. Referring now again to FIG. 10, when the bolt is oriented as shown at 44*a*, the extractor 160 and ejector 162 are oriented to eject toward the right (or three o'clock position). When the bolt is rotated to the orientation shown at 44*b*, the extractor 160 and ejector 162 are reversed and it is oriented to eject a casing toward the left (or nine o'clock position). In either orientation, the bolt cam opening 164 is properly oriented to receive the bolt cam pin 146. This is in contrast with the geometry of a prior art bolt head 148 (FIG. 11) which, if reversed, would eject a casing toward an eight o'clock position (as viewed from the rear). Thus, an ejection port is provided in the receiver body 128 at either the right 28*a* or left 28*b*, or both (see FIGS. 13, 16 and 17). Either or both ejection ports 28*a*, 28*b* are closed and covered by the lateral wall portions of the bolt carrier body 49 when in a closed, fully in-battery position. Accordingly, the same bolt 44 of the present invention can be repositioned, including by the user with simple field disassembly, to operate in either a left-handed or right-handed configuration.

Figure 13:
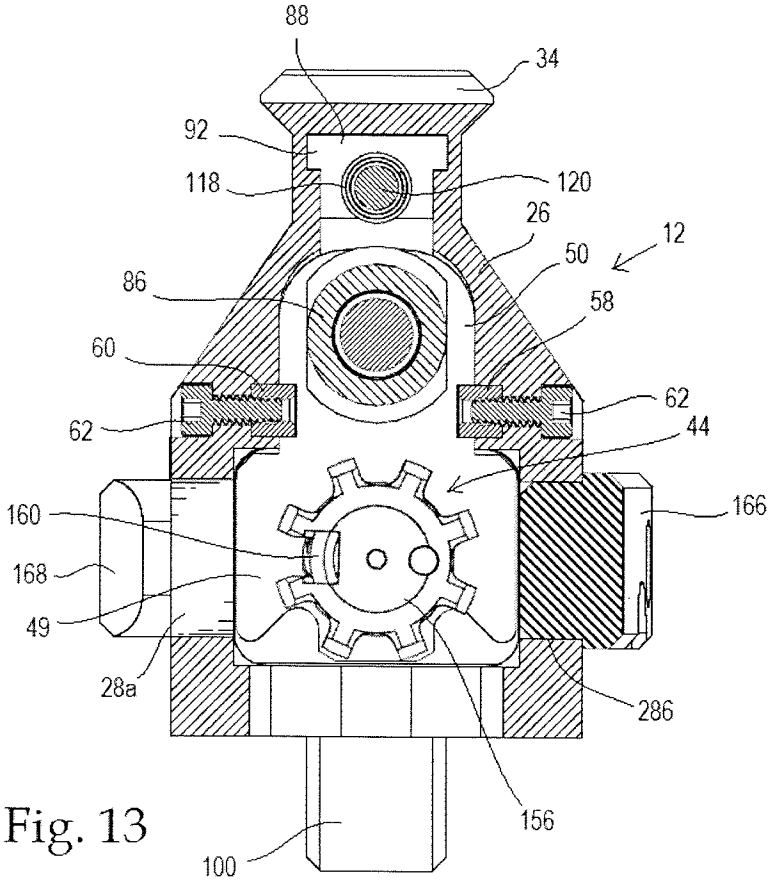
FIG. 13 is a cross-sectional view taken substantially along line 13-13 of FIG. 14, but with the bolt carrier assembly shown in a retracted position.
Figure 15:
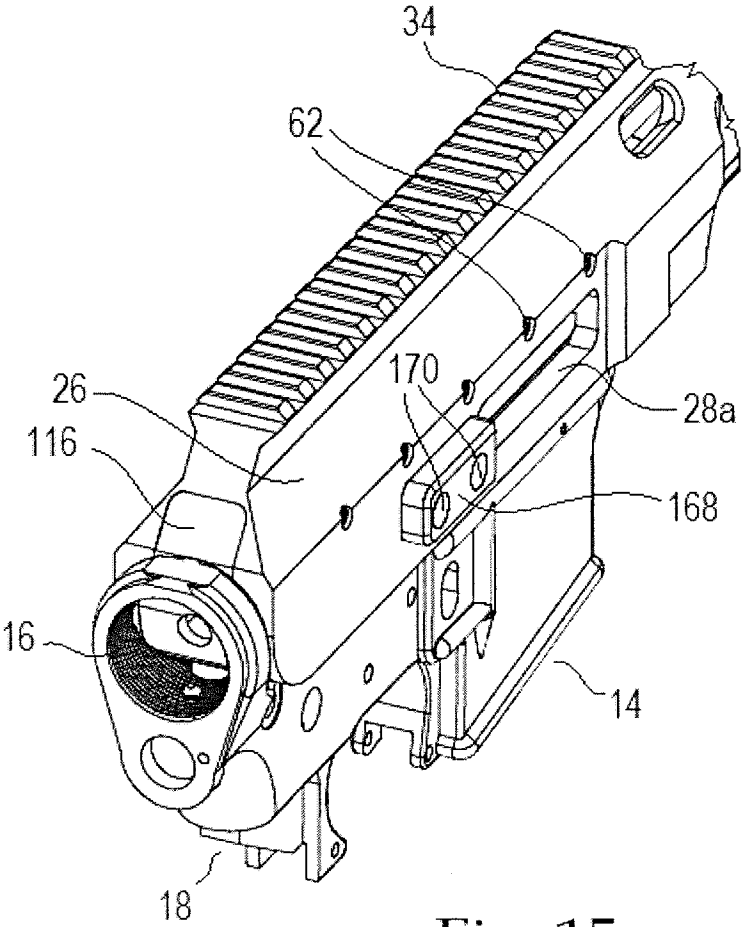
FIG. 15 is a fragmentary pictorial view of the other side thereof.
Figure 14:
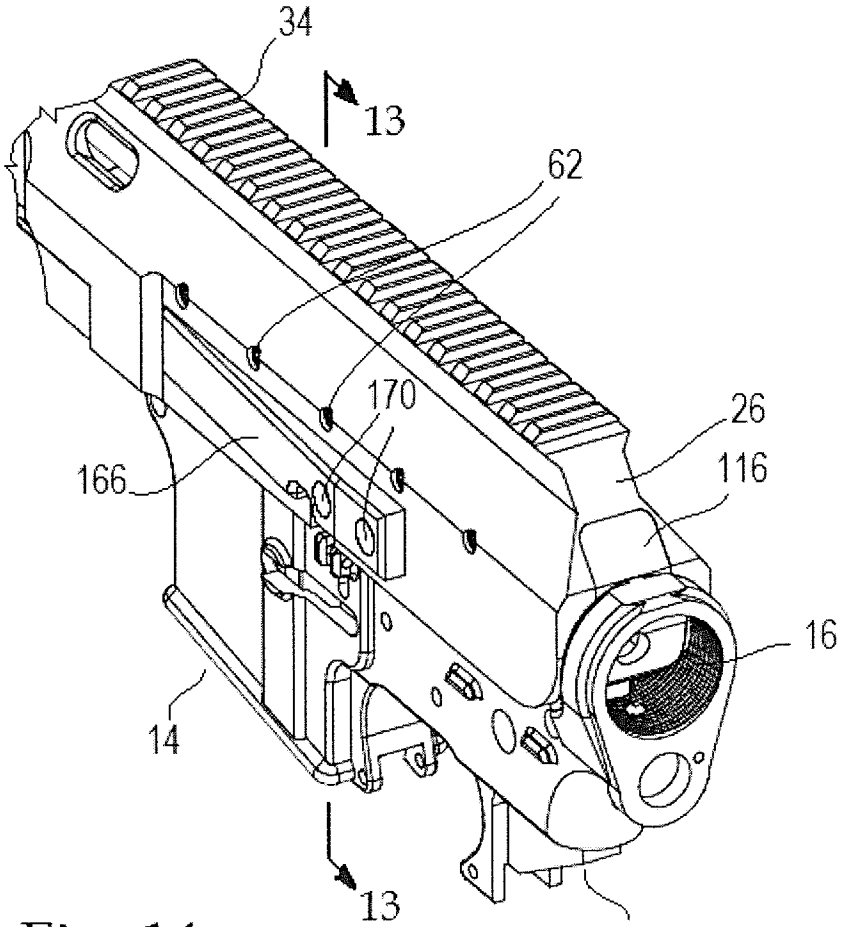
FIG. 14 is a fragmentary pictorial view of a rear portion of the upper receiver assembly.

According to another aspect of the present invention, the upper receiver body 26 can be provided with both right and left ejector ports 28*a*, 28*b* that are reconfigurable, along with the bolt 44, to select between right-handed or left-handed ejection. Referring now to FIG. 13, therein is shown is a rearwardly looking cross-sectional view through the upper receiver assembly 12 with the bolt carrier assembly 48 in an open or retracted position. This view illustrates the manner in which the upper receiver body 26 may be provided with both right and left ejector ports 28*a*, 28*b*, making the upper receiver assembly 12 fully ambidextrous and easily converted in the field from right-to left-handed operation. As shown in FIG. 13, the bolt 44 is positioned such that the extractor 160 is positioned toward the right to provide ejection of spent casings through the right ejection port 28*a*. If desired, the left ejector port 28*b* may be closed with an ejection port cover 166.

Referring now also to FIGS. 14-17, it can be seen that a shell deflector 168 may be provided rearwardly adjacent the open ejection port 226 to prevent ejected casings from exiting the port 28*a* at an angle more rearwardly than desired. Both the ejection port cover 166 and shell deflector 168 are secured to the upper receiver body 26 by a pair of interchangeable threaded fasteners 170. In this manner, after the bolt 44 has been positioned, as described above, for left- or right-handed ejection, the ejector port cover 166 and shell deflector 168 are accordingly positioned on the receiver body 26 adjacent the respective ejector ports 28*a*, 28*b*.

Figure 18:
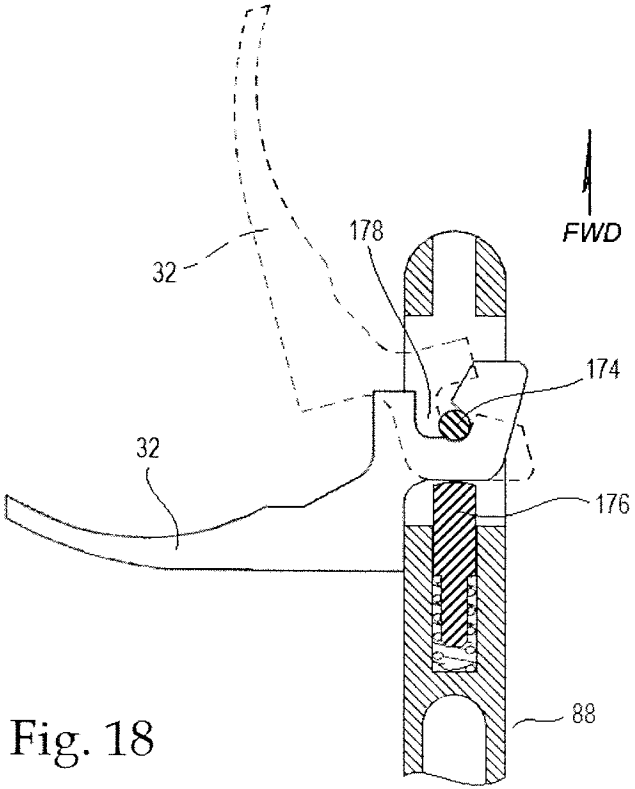
FIG. 18 is a fragmentary, partially cut-away top plan view of a forward portion of the charging handle body showing positions of the charging handle lever.

Referring now to FIG. 18, therein is shown a partially cut-away detail top plan view of the engagement between the charging handle lever 32 and charging handle body 88. A transverse window 172 is provided through a forward portion of the charging handle body 88. A retainer pin 174 extends vertically through the transverse window 172, secured to upper and lower portions of the charging handle body 88. Axially rearward of the retainer pin 174 is a forwardly-directed spring-biased detent pin 176. At the attachment end of the charging handle lever 32, there is a partially open engagement bight 178 which is positioned to engage the retainer pin 174. Against the spring bias of the detent pin 176, the charging handle lever 32 can be pivotally positioned to a forward, folded position or a rearward, use position. When in the in-use position, an abutment surface 178 of the lever 32 bears against the charging handle body 88 and provides a fulcrum against which force can be applied to rearwardly cycle the charging handle body 88. When the charging handle lever 32 is pivoted to the forward, folded position, it remains retained against the retainer pin 174 by the spring-biased detent pin 176. To remove the charging handle lever, it can be manipulated rearwardly against the detent pin 176 without pivoting about the retainer pin 174. In this manner, the bight 178 is disengaged from the retainer pin 174 and may be laterally removed from the transverse window 172. The charging handle lever 32 may then be inverted and inserted from the opposite side of the transverse window 172 for pivotal engagement with the retainer pin 174 on the opposite side.

As described above with reference to FIGS. 10-18, it can be seen that the upper receiver assembly 12 of the present invention can be fully ambidextrous and easily switched with few or no tools from right-handed to left-handed operation. The left or right position of the charging handle lever 32 can be chosen independently of the ejection direction of the bolt 44.

Referring now FIGS. 19-22, therein is shown a series of views illustrating the process of field disassembly or field stripping of the upper receiver assembly of this embodiment of the present invention. These figures show a side plan view of a rear portion of the upper receiver assembly 12 with the upper receiver body 26 and lower forearm cover 40 cut away in longitudinal section. For clarity of illustration, the recoil spring 66 and charging handle return spring 118 are not shown in their full length in these figures. In the case of the recoil spring 66, it should be understood that the spring extends into the hollow op rod 86. It is also to be understood that field stripping can be accomplished while the upper receiver assembly 12 is attached to a lower receiver 14 and tipped open on the forward pivot pin 24 or while the upper assembly 12 is completely separated from the lower receiver 14.

Figure 19:
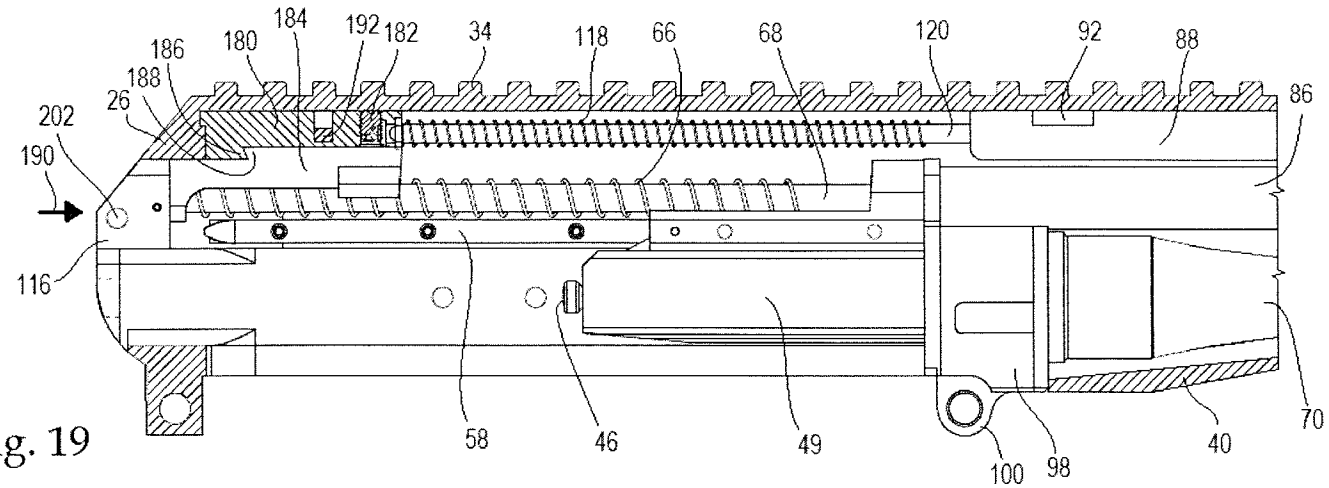
FIGS. 19-22 are a series of fragmentary partially cut-away views of a rear portion of the upper receiver assembly illustrating the steps involved in field stripping disassembly.

Referring first to FIG. 19, therein is shown at 180 a fixed portion of the recoil buffer. While the receiver body 26 is preferably milled from a lightweight aluminum alloy, the buffer fixed portion 180 is preferably made of a harder material, such as steel. The fixed portion 180 may be configured to fit in engagement slot (not shown) formed within the receiver body 26 and either permanently fixed or rigidly fixed, such as by a set screw 182. The buffer fixed portion 180 includes a downwardly and forwardly directed tooth 186 configured to engage in a mating tooth 188 of a removable portion 184 of the recoil buffer system. The buffer removable portion 184 is secured to the rear closure plate 116 and recoil spring guide rod 68. When the upper receiver assembly 12 has been either tilted open on pivot pin 24 or separated from the lower receiver 14 (as shown in FIGS. 19-22), the recoil spring and buffer system may be removed from the receiver body 26 by applying forward force (arrow 194) against the rear cover plate 116 and against the force of the recoil spring 66, which otherwise retains the removable portion 184 of the buffer engaged against the fixed portion 180. If desired, the buffer system may be further secured against inadvertent displacement by use of a small but strong magnet 190 (such as a 0.25 inch diameter×0.10 inch thick rare earth magnet) set into a recess 192 in the buffer fixed portion 180. Optionally, a locking mechanism in the form of a captured cross pin 200, similar in design to a take-down pin 22 or pivot pin 24 may be provided on the upper receiver body 26 and extend through a transverse opening 202 in the rear closure plate 116 to prevent inadvertent dislodgement of the removable buffer block 184.

Figure 20:
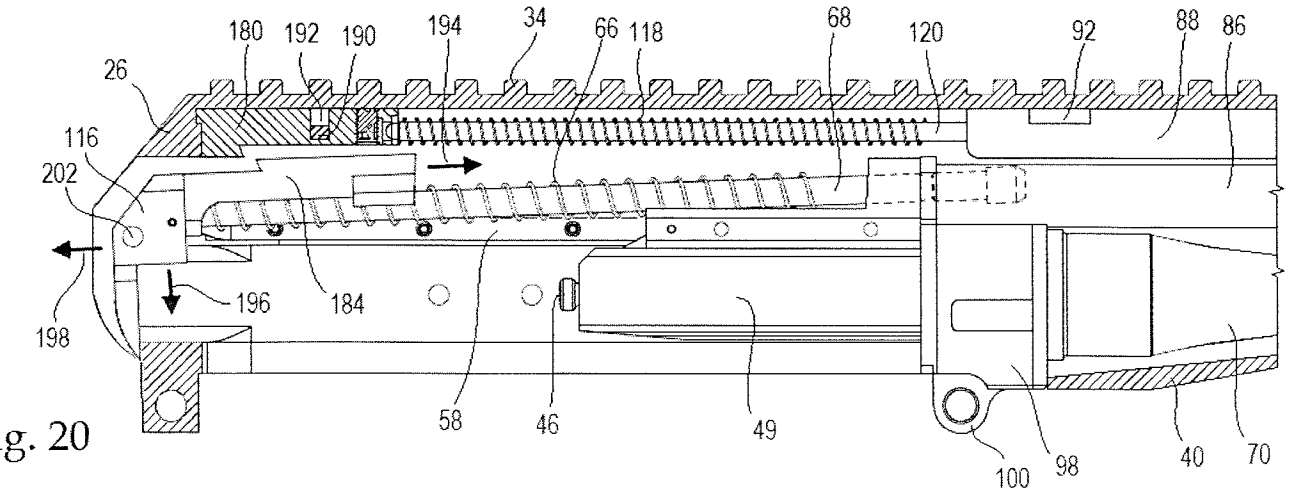

As shown in FIG. 20, once the respective teeth 186, 188 of the fixed and removable portions 180, 184 of the buffer have been disengaged from each other by the forward movement (arrow 194) and a slight downward movement (arrow 196), the entire recoil buffer assembly, including removable buffer portion 184, rear cover plate 116, guide rod 68, and recoil spring 66 may be rearwardly pulled (arrow 198) from the receiver body 26.

Figure 21:
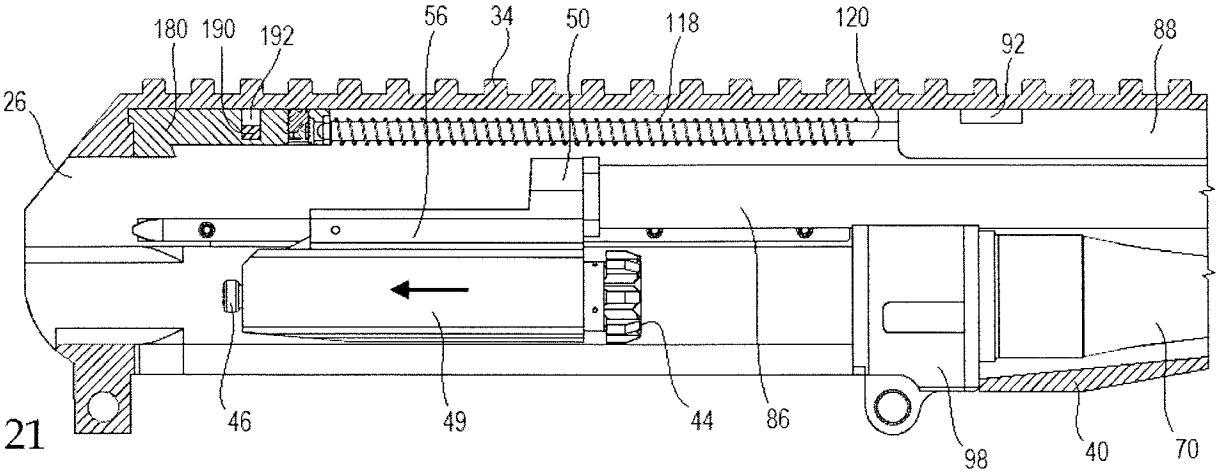
Figure 22:
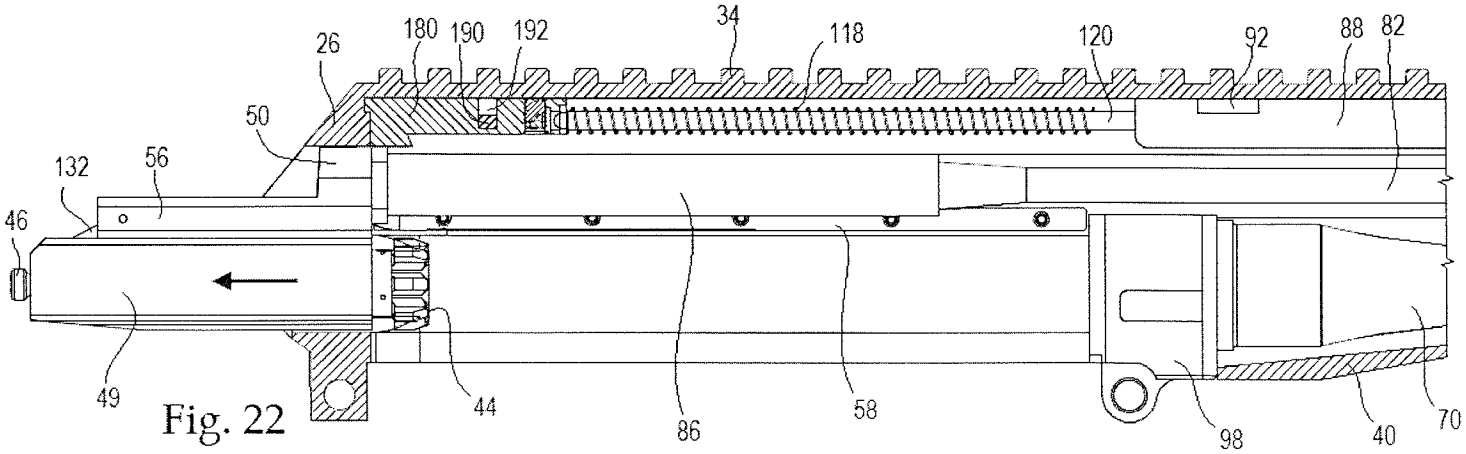

As shown in FIG. 21, the bolt carrier assembly is now free to slide rearwardly along guide rails 58, 60. In this manner, the entire bolt carrier assembly, including the bolt carrier body 49, bolt 44, firing pin 46, op rod 86, and piston 82, easily slides rearwardly out the back of the receiver body 26.

Figure 23:
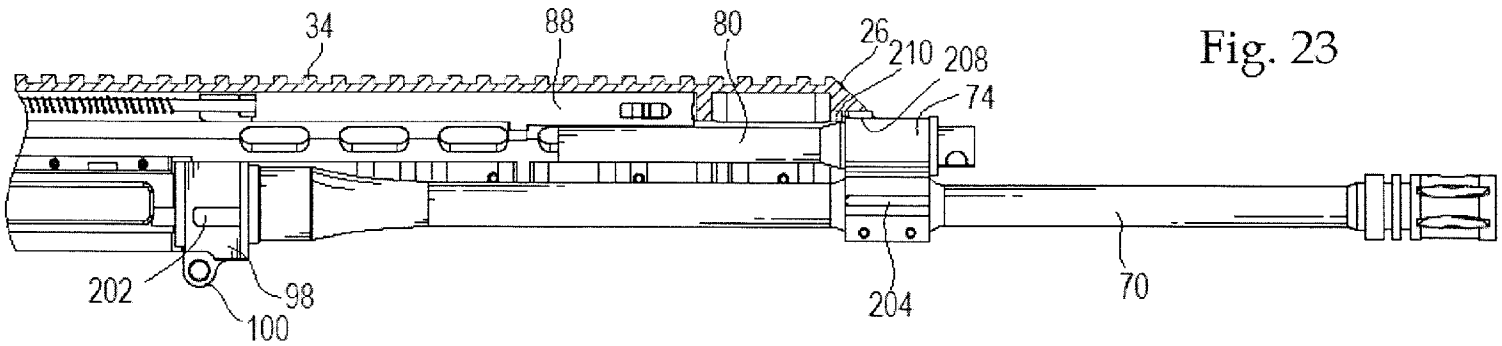
FIG. 23 is a fragmentary partially cut-away view of a forward portion of the receiver body and barrel assembly.
Figure 24:
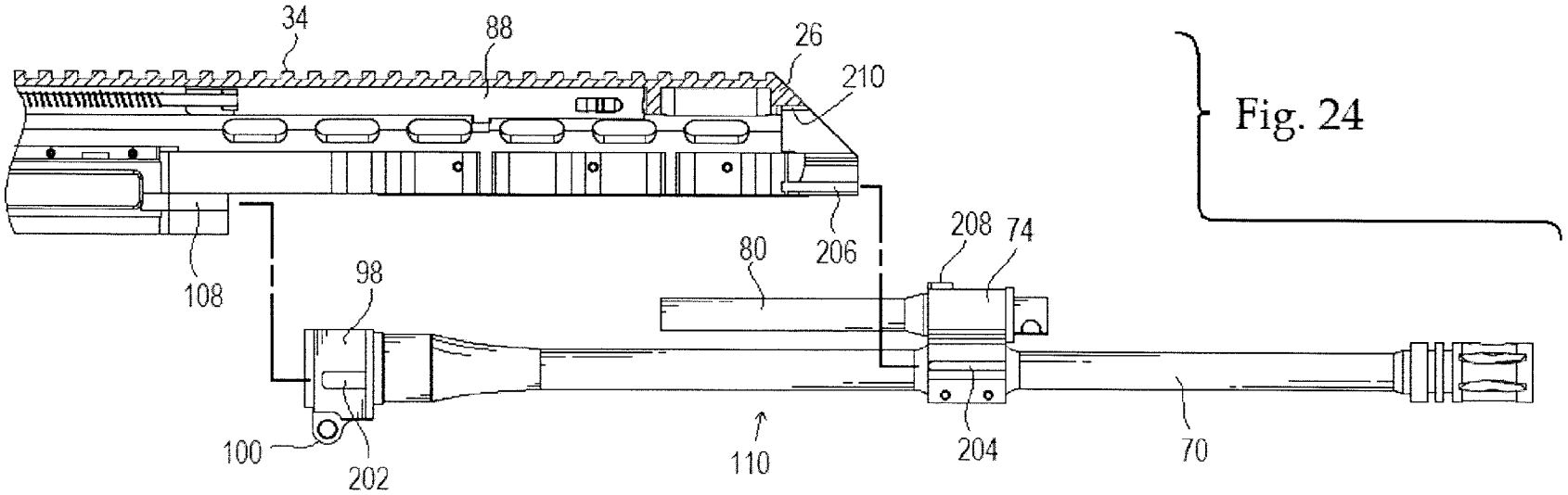
FIG. 24 is a disassembled view thereof.
Figure 25:
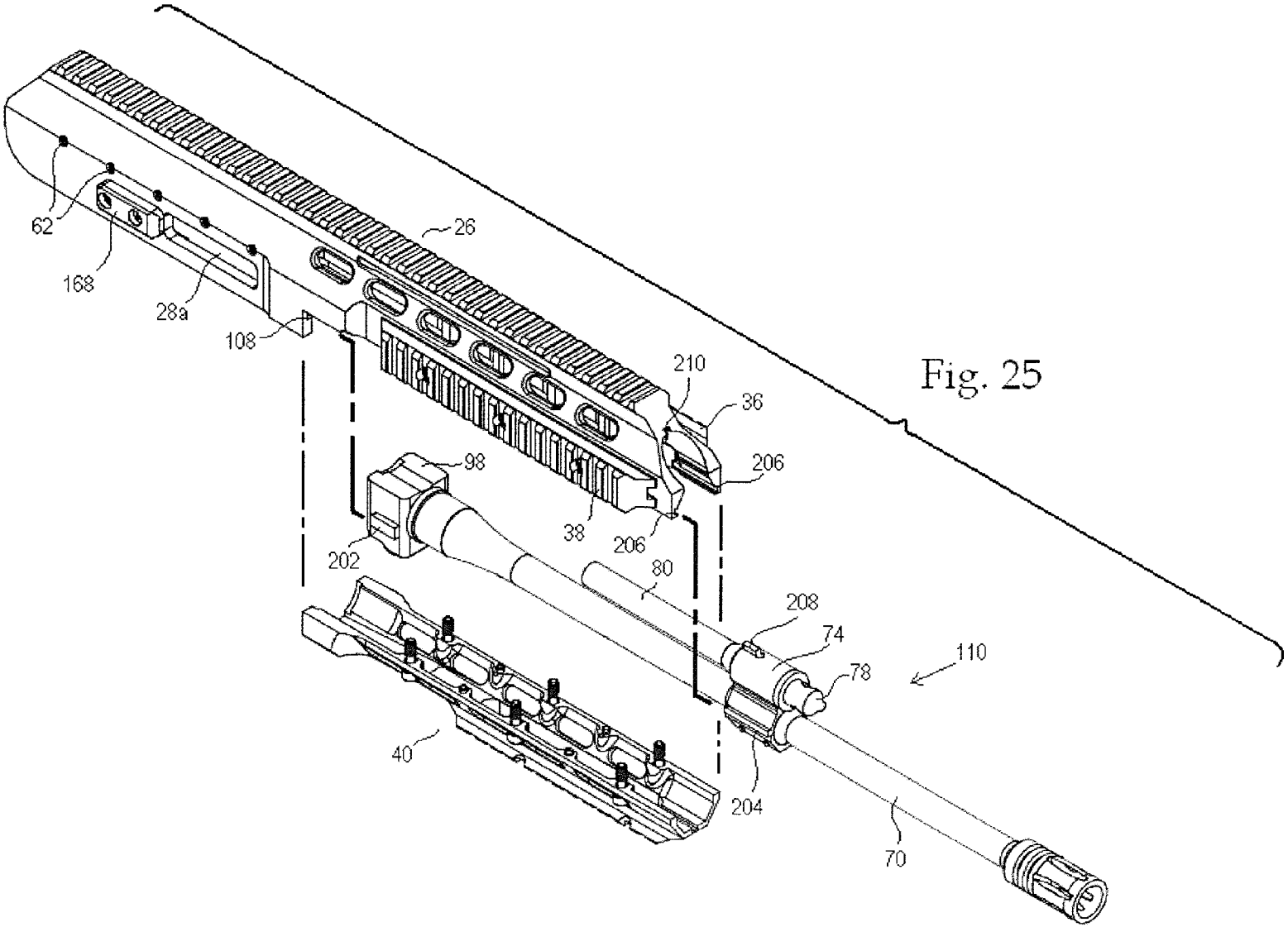
FIG. 25 is a pictorial exploded view of the upper receiver body, barrel assembly, and lower forearm cover.

Referring now to FIGS. 23-25, therein is shown the manner in which the barrel assembly 110 may be securely attached to the upper receiver body 26 and quickly detachable therefrom for exchange. The barrel assembly 110 includes a barrel trunnion 98 with a downwardly-extending lug 100 by which the trunnion 98 is directly secured to the forward pivot pin 24 of a standard lower receiver 14. The barrel trunnion 98 includes a pair of laterally opposed, longitudinally extending engagement rails (or keys) 102, 104 which are configured to slidingly engage a rear pair of engagement grooves (or keyways) 106, 108 formed inside the receiver body 26.

The gas block 74 also includes a pair of laterally opposed, longitudinally extending engagement rails 204 which are configured to slidingly engage a pair of forward engagement grooves 206 formed on the interior of the upper receiver body 26.

Referring also again to FIG. 6, therein it can be seen that the relative exterior dimensions of the gas block 74 and interior dimensions of the upper receiver body 26 may be configured such that there is a minute gap between these members around most of the periphery of the gas block 74, with engagement being predominantly or exclusively between the engagement rails 204 and engagement grooves 206. In this manner, heat transfer between the gas block 74 and receiver body 26 (and lower forearm cover 40) is minimized. If desired, an upper engagement key or rail 208 may be provided on the gas block 74 and an upper engagement groove or keyway 210 provided at the forward end of the upper receiver body 128 to provide additional engagement stability.

Referring particularly now FIG. 25, the lower forearm cover 40 may be secured to the upper receiver body 26 with captive threaded fasteners 112. When the forearm cover 40 is secured in place, the barrel trunnion 98 is held in place by longitudinal engagement of the trunnion rails 102, 104 and rear engagement grooves 106, 108 and against longitudinal displacement by the lower forearm cover 40. As in the previously-described embodiment, the barrel assembly 110 is firmly secured against lateral or vertical movement within the unitary upper receiver body 26. If desired, the dimensions of a lower portion of the gas block 74 may be machined oversized (i.e., "proud") in the range of 0.004 inches to 0.007 inches in order to assure that the lower forearm cover 40 holds it tightly in place. Although the barrel trunnion 98 is firmly secured against longitudinal displacement, the remainder of the barrel assembly 110 may freely expand and contract in the longitudinal direction as a result of thermal changes independent of the upper receiver body 26.

Referring now to FIG. 26, therein is shown a two-stage recoil spring and buffer system. A first, main recoil spring 212 is positioned on the guide rod 154 and extends into the hollow op rod 86, much like that previously described with respect to other embodiments herein. A secondary buffer spring 214, which is relatively significantly shorter and heavier, is situated forward of and axially aligned with the main recoil spring 212. Between the springs 212, 214 is a block 216 which may act as a connector.

Referring now also to FIGS. 27 and 28, it can be seen that, as the bolt carrier assembly 48 is driven rearwardly, either by force of gas pressure acting on the piston 82 (as shown) or manually retracted with the charging handle, the block 216 comes into contact with the end of the guide rod 68. This limits and prevents further compression of the main recoil spring 212, forcing further movement to compress the secondary recoil spring 214. This final travel is limited to the very last portion of the recoil stroke, which may be no more than about 0.25 inches. Because the secondary recoil spring 214 is significantly stiffer than the main recoil spring 212, a significant amount of recoil force is adsorbed in the final portion of travel and the velocity of the recoiling bolt carrier assembly 48 is quickly and significantly decelerated prior to impact contact between the forward lug 50 and the removable buffer block 184. The heavier secondary spring 214 acts as a buffer, minimizing the impact of the bolt carrier assembly 48 against the lower buffer block 184.

Figure 29:
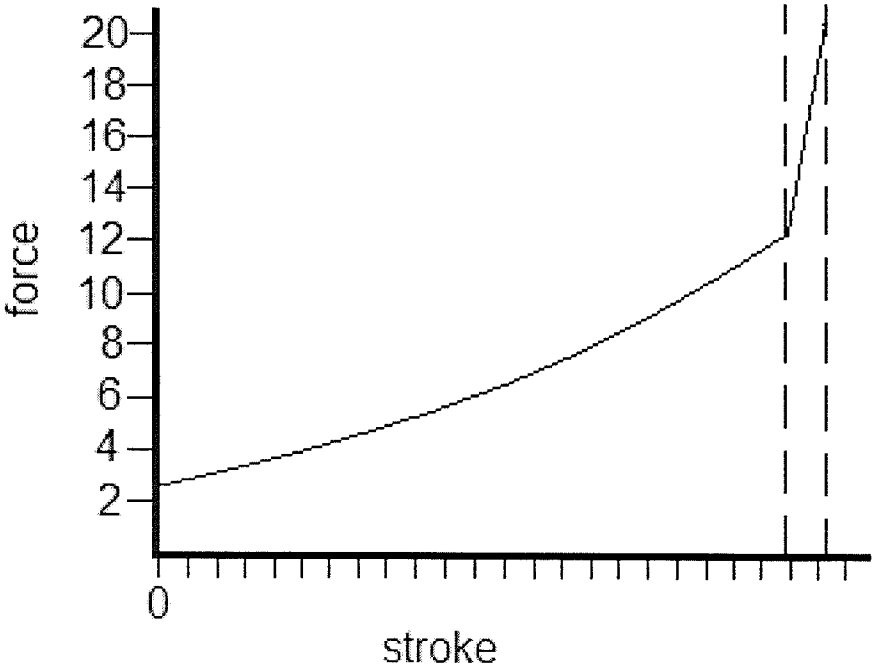
FIG. 29 is a graph illustrating the force curve of the two-stage recoil spring.
Figure 30:
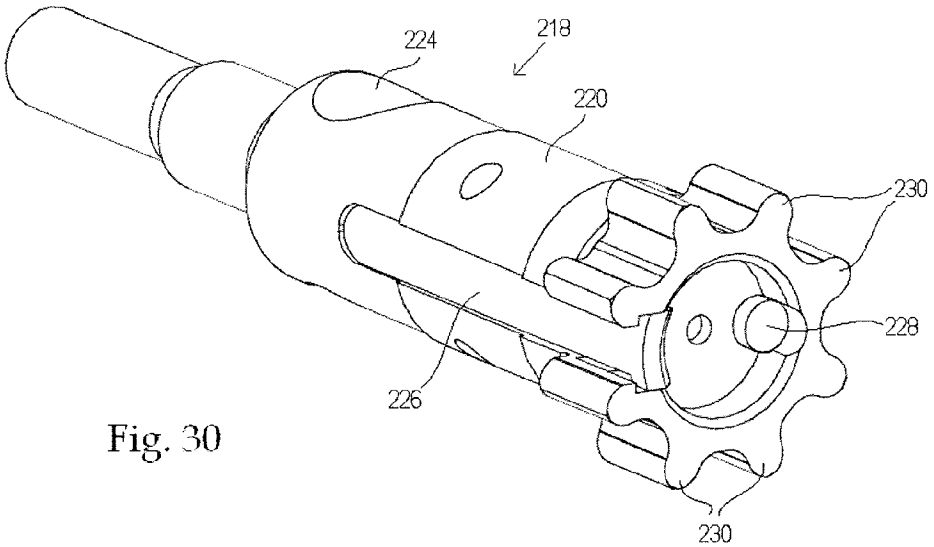
FIGS. 30 and 31 are isometric views of a bolt having a novel lug profile.
Figure 31:
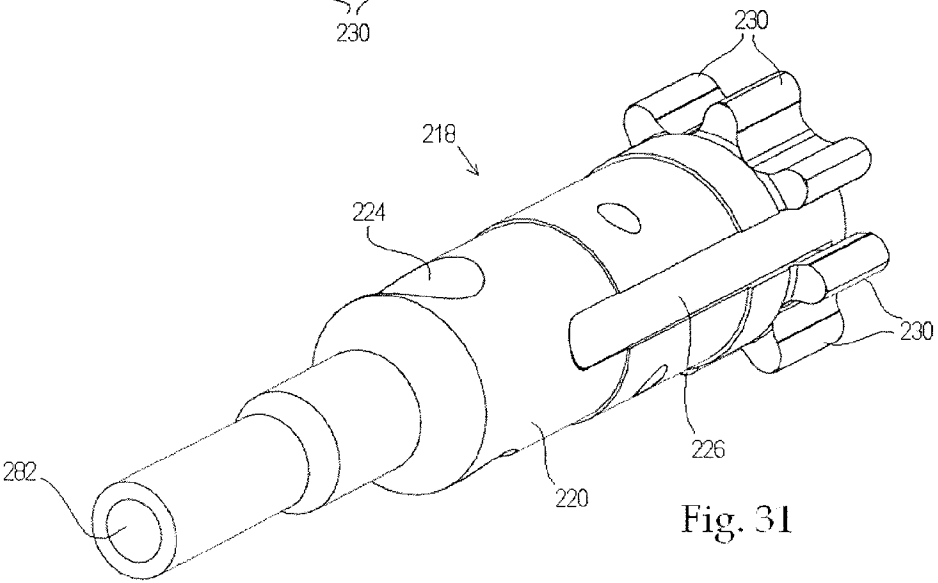
Figure 32:
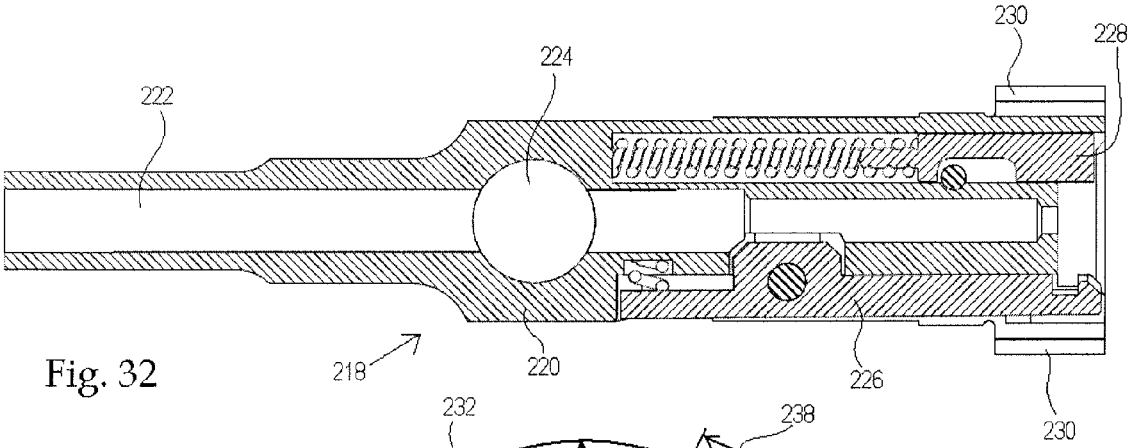
FIG. 32 is a longitudinal sectional view taken substantially along line 32-32 of FIG. 33.

This rapid adsorption of force is illustrated graphically in FIG. 29. At 0 (zero) position of the stroke, the bolt carrier assembly 48 is in battery, where the main recoil spring 212 is exerting about 4 pounds of force. As the action cycles rearwardly along the stroke curve, the force of the primary recoil spring 212 climbs until the block 216 contacts the end of the guide rod 68 and prevents any further compression of the primary spring 212. The stroke curve (spring resistance force) climbs steeply in the final portion of the stroke. The deceleration (negative acceleration) of the bolt carrier assembly would be represented by a curve (not shown) substantially inverse of the force curve illustrated, with a significant portion of the deceleration occurring in a relatively small and final portion of the stroke cycle.

Referring now to FIGS. 30-33, therein is shown at 218 a bolt according to another aspect of the invention in which the profile of the bolt lugs has an improved geometry. In most respects, the bolt 218 is the same in function and operation as that described above (at 44). It includes a bolt body 220 having a central longitudinal bore 222 for receiving the firing pin (not shown), a transverse bolt cam opening 224, a spring-biased pivoting extractor 226, and spring-biased ejector 228. As described above with respect to the second embodiment, the illustrated bolt 218 has an extractor/ejector orientation that allows it to be reversed for left- or right-handed ejection of spent cartridge casings. This includes that the extractor 226 is oriented circumferentially between bolt lugs 230, rather than carrying a lug as is the case in a prior art AR15/M16 bolt (see FIG. 11). The improved bolt lug geometry described herein may be incorporated successfully into either style of bolt.

Figure 33:
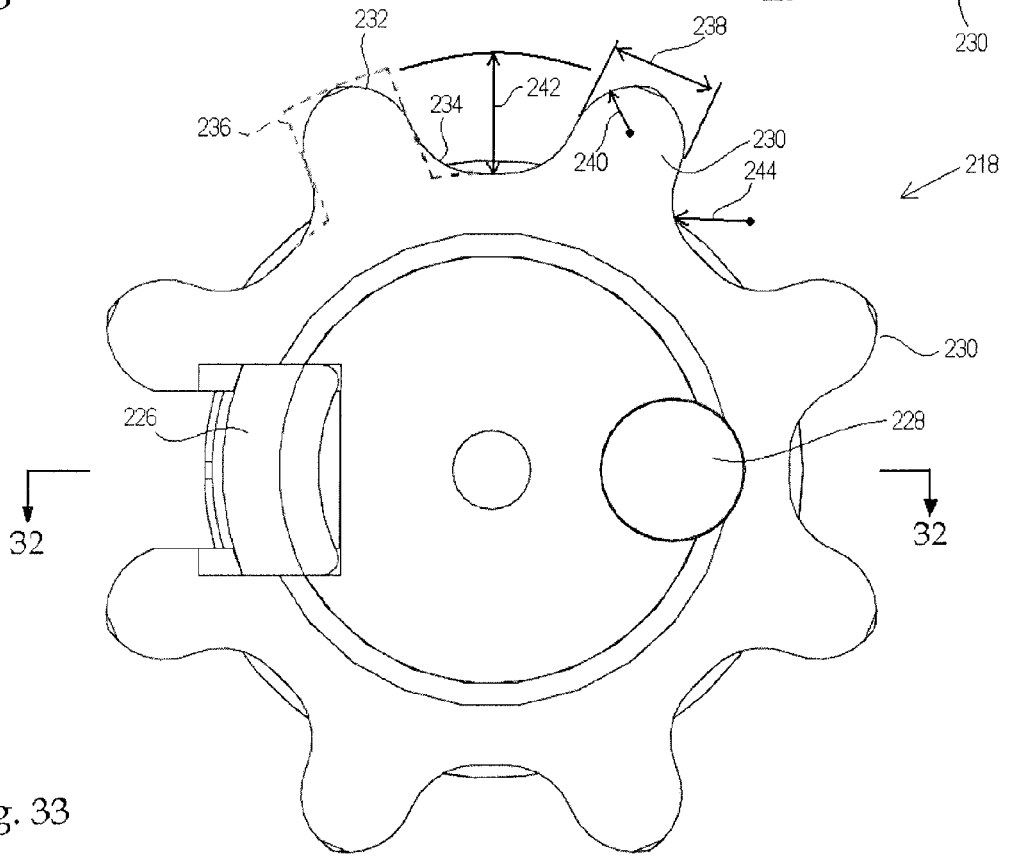
FIG. 33 is an enlarged end plan view of the bolt face profile.

Referring now in particular to FIG. 33, it can be seen that the peripheral profile of the bolt face formed by the lugs 230 is a generally continuous curvilinear shape, rather than the angular, generally radial and circumferential shape of the prior art bolt 148 (see FIG. 11) or reversible bolt 146 (FIG. 12) described above. The outer ends of each lug are rounded to eliminate a sharp longitudinal edge. The spaces between lugs are likewise rounded as troughs at the base of each adjacent lug, eliminating a sharp cut at the base of each lug. Although this profile narrows the width of each lug at the outer end 232, the amount of material at the base 234 where the lug joins the body of the bolt face is increased by 20-30%. Moreover, the elimination of sharp cuts at these locations greatly enhances the structural integrity of the bolt face and lugs 230 to resist shear forces and reduces stress points where cracking in hardened materials is most likely to originate and occur. An outline of one prior art lug profile is shown for comparison in phantom line at 236 in FIG. 33. The overall width (shown at 238) of the lug 230 is maintained to be substantially that of the prior art lug 236. The curvature of the outer end 232 may have a radius (shown at 240) substantially half the width (shown at 238) of the lug 230. Likewise, the overall depth (shown at 242) of each lug 230 is maintained to be substantially that of the prior art lug 236. The curved profile of the space between adjacent lugs 230 may have a radius (shown at 244) that is substantially half the circumferential distance between the lugs 230 such that the smoothest possible curvilinear transition is provided to the profile.

Many features have been listed with particular configurations, options, and embodiments. Any one or more of the features described may be added to or combined with any of the other embodiments or other standard devices to create alternate combinations and embodiments. Although the examples given include many specificities, they are intended as illustrative of only one possible embodiment of the invention. Other embodiments and modifications will, undoubtedly, occur to those skilled in the art. Thus, the examples given should only be interpreted as illustrations of some of the preferred embodiments of the invention, and the full scope of the invention should be determined by the appended claims and their legal equivalents.

What is claimed is:

1. An upper receiver assembly for use with an AR15-type lower receiver in which the lower receiver attaches to an upper receiver assembly by way of a forward pivot pin and a rearward takedown pin, comprising:

a monolithic upper receiver and forearm housing configured for operable mating engagement with a lower receiver assembly, the upper receiver and forearm housing including a first lug for connection to the lower receiver using the takedown pin;

a barrel having a breech end, a muzzle end, and a bore axis;

a barrel trunnion at the breech end having a second lug for direct connection to the lower receiver using the pivot pin;

a gas block positioned on the barrel;

a bolt carrier assembly including a longitudinal slot and rail engagement with the upper receiver assembly on which the bolt carrier assembly slidably reciprocates;

a long-stroke gas-piston actuation system having a longitudinal axis parallel to and offset from the bore axis, the gas actuation system including a gas tube extending rearwardly from the gas block and a piston extending forwardly from the bolt carrier assembly; and a recoil spring assembly housed within the monolithic upper receiver and forearm housing and extending coaxially with the longitudinal axis of the gas-piston actuation assembly, wherein the barrel trunnion is configured for engagement with the upper receiver and forearm housing with longitudinal keyway features, one of a keyway or engagement rail being on the barrel trunnion and the other on the upper receiver and forearm housing; and wherein the gas block is configured for engagement with the upper receiver and forearm housing with longitudinal keyway features, one of a keyway or engagement rail being on the gas block and the other on the upper receiver and forearm housing.

2. The upper receiver assembly of claim 1, wherein the barrel trunnion includes laterally positioned keyway features on opposite sides thereof, the gas block includes laterally positioned keyway features on opposite sides thereof and an upper keyway feature thereon.

3. The upper receiver assembly of claim 1, wherein the gas block includes a gas port to the barrel and a manually-adjustable gas control valve.

4. The upper receiver assembly of claim 3, further comprising a closable cleaning opening in the gas block opposite and in alignment with the gas port to the barrel.

5. The upper receiver assembly of claim 1, wherein the bolt carrier assembly includes a cam pin and a rotatable bolt, the bolt having a transverse cam pin opening and an extractor and ejector positioned laterally substantially opposite each other, the cam pin opening having a axis substantially perpendicular to the transverse lateral positions of the extractor and ejector, whereby the bolt can be reversed for left or right ejection.

6. The upper receiver assembly of claim 1, further comprising a removable lower forearm cover, wherein the barrel trunnion is longitudinally held in engagement with the keyway features of the upper receiver and forearm housing by assembly of the lower forearm cover.

7. The upper receiver assembly of claim 6, wherein the lower forearm cover is removably attached to the upper receiver and forearm housing with threaded fasteners.

8. The upper receiver assembly of claim 1, wherein the recoil spring assembly comprises coil spring with a guide rod axially supported therein, the bolt carrier assembly compressing the coil spring when cycled rearwardly and the coil spring having a first stage portion and a second stage portion in axial alignment with a blocking member positioned intermediate of the first stage and second stage portions, the guide rod having a length selected such that, at a preselected point of the bolt carrier assembly's rearward cycle, an end portion of the guide rod will contact the blocking member preventing further compression of the first stage portion and limiting further compression to the second stage portion.

9. The upper receiver assembly of claim 8, wherein the second stage portion of the coil spring is stiffer than the first stage portion.

10. The upper receiver assembly of claim 1, wherein the recoil spring assembly comprises a two-part, separably engageable recoil block, a first part fixed to the upper receiver and forearm housing and a second part which is fixed to a recoil spring guide rod.

11. The upper receiver assembly of claim 10, wherein the first and second parts separably engage with mating engagement surfaces which is displaceable by forward movement of the second part relative to the first part.

12. The upper receiver assembly of claim 11, further comprising a removable transverse fastener member extending through the upper receiver and forearm housing and a portion of the recoil spring assembly to prevent forward movement of the recoil block second part.

13. The upper receiver assembly of claim 1, wherein the bolt carrier assembly includes a body in which a bolt and firing pin are received, the body at a rearward end having a firing pin retention mechanism, the mechanism including a pivoting member mounted on the body, the pivoting member pivotable between a first position wherein rearward removal of the firing pin is blocked and a second position wherein the firing pin is rearwardly removable from the bolt carrier assembly.

14. The upper receiver assembly of claim 13, wherein the pivoting member is spring bias toward the first position and manually displaceable toward the second position.

15. The upper receiver assembly of claim 13, wherein the firing pin retention mechanism further comprises a transversely slidable gate member, the gate member slidable between a first position and second position wherein the gate member blocks rearward removal of the firing pin and a second position wherein the firing pin is rearwardly removable from the bolt carrier assembly, movement of the pivoting member between first and second positions causing relative movement of the gate member between first and second positions.

16. The upper receiver assembly of claim 1, further comprising a bolt having a head with a plurality of substantially equally-spaced radially-extending lugs and an extractor situated circumferentially between two adjacent lugs.

17. The upper receiver assembly of claim 1, further comprising a bolt having a head with a plurality of substantially equally-spaced radially-extending lugs of a defined height and width, the lugs having a substantially continuously curved transverse profile, curvature of outer ends of the lugs transitioning to a curved profile of spaces between the lugs.

18. The upper receiver assembly of claim 17, the bolt further comprising an extractor situated circumferentially between two adjacent lugs.

* * * * *